US007134513B1

(12) United States Patent
Randall et al.

(10) Patent No.: US 7,134,513 B1
(45) Date of Patent: Nov. 14, 2006

(54) DRIVE MECHANISM FOR BORING MACHINE

(75) Inventors: Guy Randall, Wooster, OH (US); Neil M. Baker, Gambier, OH (US); Joseph R. Szarka, Wooster, OH (US); Justin A. Wheeler, Mansfield, OH (US); Stephen Berger, West Salem, OH (US)

(73) Assignee: Astec Industries, Inc., Chattanooga, TX (US)

( * ) Notice: Subject to any disclaimer, the term of this patent is extended or adjusted under 35 U.S.C. 154(b) by 279 days.

(21) Appl. No.: 10/886,808

(22) Filed: Jul. 8, 2004

Related U.S. Application Data

(60) Provisional application No. 60/485,519, filed on Jul. 9, 2003.

(51) Int. Cl.
*E21B 7/20* (2006.01)

(52) U.S. Cl. ..... 175/122; 175/195

(58) Field of Classification Search ..... None
See application file for complete search history.

(56) References Cited

U.S. PATENT DOCUMENTS

| | | | | |
|---|---|---|---|---|
| 2,196,260 | A | | 4/1940 | Gatto |
| 2,319,512 | A | | 5/1943 | Parrish |
| 2,835,472 | A | | 5/1958 | Osborn |
| 3,078,933 | A | | 2/1963 | Orner |
| 3,870,279 | A | | 3/1975 | Century |
| 4,025,120 | A | | 5/1977 | Balinov et al. |
| 4,184,715 | A | | 1/1980 | Lanfermann |
| 4,553,612 | A | * | 11/1985 | Durham ..... 175/122 |
| 4,582,146 | A | * | 4/1986 | Becker ..... 173/149 |
| 6,332,502 | B1 | | 12/2001 | Mills et al. |
| 6,374,929 | B1 | | 4/2002 | Barbera |
| 6,533,046 | B1 | | 3/2003 | Mills et al. |
| 6,688,408 | B1 | * | 2/2004 | Barbera et al. ..... 175/45 |
| 6,715,565 | B1 | * | 4/2004 | Barbera ..... 175/19 |
| 6,923,594 | B1 | * | 8/2005 | Sovik et al. ..... 404/96 |
| 2002/0079137 | A1 | | 6/2002 | Mills et al. |
| 2002/0112891 | A1 | | 8/2002 | Barbera |

* cited by examiner

*Primary Examiner*—Frank Tsay
(74) *Attorney, Agent, or Firm*—Chambliss, Bahner & Stophel, PC

(57) ABSTRACT

An auger boring machine includes a track having an initial end and a terminal end, and the track is provided with a rack. The boring machine also includes a sled that is mounted on the track and adapted to be moved between the initial end and the terminal end of the track. The boring machine also includes a mechanism for rotating an auger on the sled and a drive system. The drive system includes a pinion which is mounted so as to engage with the rack on the track and a mechanism for rotating the pinion so as to drive the sled along the track.

20 Claims, 21 Drawing Sheets

DRIVE MECHANISM FOR BORING MACHINE

CROSS REFERENCE TO RELATED APPLICATION

This application claims the benefit of U.S. Provisional Application No. 60/485,519, which was filed on Jul. 9, 2003.

FIELD OF THE INVENTION

The invention relates generally to auger-type boring machines which include a sled that moves along a track. More particularly, the invention relates to a drive mechanism for moving the sled along the track.

BACKGROUND OF THE INVENTION

Subterranean boring machines are used to install a casing or pipe in the ground without excavating a trench for the casing. The boring machine generally includes a sled that rolls along a track comprised of a pair of track rails, which track is generally placed in a pit that is dug to a depth to permit the sled to be placed in alignment and on grade with the desired underground installation. A section of casing is located on the front end of the sled with a cutting head or auger mounted thereon. The sled carries a rotation mechanism for rotating the auger and a translation mechanism for driving the sled along the track so as to drive the auger section into the ground as it rotates, along with a surrounding casing section. Generally, the translation mechanism includes a pair of dogs which engage drive holes in the track rails and a pair of hydraulic actuators. In operation, the dogs engage a set of drive holes and the hydraulic actuators are extended to drive the sled in the boring direction. When the actuators have extended to their maximum length, the dogs are disengaged from the track rails and the actuators are fully retracted. Then the dogs engage a second set of drive holes and the actuators are extended to drive the sled another step in the boring direction. This incremental driving process is continued as the sled travels to the terminal end of the track. Once the sled has reached the terminal end of the track and has driven an auger section and a casing section into the ground by the distance of its travel, the casing and auger sections are released from the sled and the sled is retracted from the terminal end back to the initial end. Sections of casing and auger are then added to the ends of the casing and auger sections that protrude from the bore, and the incremental driving process is repeated until enough sections of the casing have been driven into the ground to comprise the desired overall length of the subterranean installation. Once all of the sections of casing are installed, the auger sections must be removed from the casing sections and, unless the casings are installed merely for drainage, an underground utility product must then be placed within the casings.

One conventional means that is employed to move the sled in the reverse direction on the track employs the same hydraulic actuators that are used to drive the sled forward (in the boring direction). In this conventional reverse translation process, these actuators are repeatedly extended and retracted in conjunction with the incremental engagement and disengagement of the dogs in the drive holes. That is, the dogs are retracted from a pair of drive holes and the actuators are extended to drive the dogs in the rearward direction until they are aligned with the previous set of drive holes. The dogs are then engaged with the drive holes and the actuators retracted to move the sled in the rearward direction. This repeated extension and retraction process is continued until the sled reaches the initial end of the track. Since this process for moving the sled in the reverse direction on the track employs the same hydraulic actuators and dogs as are used in moving the sled in the boring direction, movement of the sled in the reverse direction, whether to move the sled back to receive a section of casing and auger, to withdraw an auger section or for any other purpose, will generally take as much time as it takes to move it in the boring direction.

Another known method for moving the sled in the reverse direction on the track may be employed when the sled is equipped with a power winch. In the practice of this method, a wire rope is extended from the winch and attached to a fixture at the initial end of the track, and the winch is used to pull the sled back from the terminal end. This method may be faster than the incremental method described above; however, it is generally only suitable for moving the sled back to receive a section of casing and auger for further boring.

It is known to provide a supplemental drive system for a subterranean boring machine, which supplemental drive system may be used to move the sled in the reverse direction more quickly than the conventional drive system. Thus, for example, U.S. Pat. No. 6,374,929 and U.S. Pat. No. 6,715,565 of Barbera both describe a supplemental drive system which includes a primary and a secondary drive wheel on each side of the sled. A drive sprocket is attached to the primary drive wheel and the primary drive wheel is mounted on the shaft of a hydraulic motor. An idler sprocket is mounted on the secondary drive wheel, and a chain connects the drive sprocket and the idler sprocket. Each supplemental drive system is mounted so that the drive wheels are biased against the track by a pair of springs to cause the primary and secondary drive wheels to frictionally engage the track. The drive motor drives the primary drive wheel, which in turn, drives the secondary drive wheel so as to move the sled along the track when the sled is not driving an auger section and surrounding casing section into the ground. The Barbera system may be subject to slippage if oil or water is introduced on the track or if its springs do not provide sufficient biasing force to ensure that the wheels frictionally engage the track. Furthermore, it is believed that the Barbera system for frictional engagement does not have the power to withdraw auger sections from the installed casings.

It would be desirable if a drive system could be developed that would be more efficient and less complex than the Barbera system or other known systems for moving the sled along the track.

ADVANTAGES OF THE INVENTION

Among the advantages of the invention is that it provides a supplemental drive mechanism that requires fewer components and is more efficient than the Barbera system or other known systems for moving the sled along the track. Another advantage of the invention is that it provides a means for moving the sled along the track at a rate faster than conventional systems. Still another advantage of the invention is that is provides a single means by which the sled can be moved away from or towards the bore regardless of the stage of the boring operation in which such movement occurs.

Additional advantages of the invention will become apparent from an examination of the drawings and the ensuing description.

EXPLANATION OF TECHNICAL TERMS

As used herein, the term "pinion" refers to a gear-toothed wheel, sprocket, worm gear or similar device that is adapted to mesh with a rack for converting rotary motion into linear motion.

As used herein, the term "rack" refers to a straight, toothed bar or similar device that is adapted to mesh with a pinion for converting rotary motion into linear motion. A rack may include, but is not limited to, a series of holes, slots, bar segments or chain links that are adapted to mesh with a pinion.

As used herein, the term "forward" and similar terms, when used in connection with a description of the relative motion of a sled of an auger boring machine along a track, refers to the direction towards the bore.

As used herein, the terms "rearward", "backward" and similar terms, when used in connection with a description of the relative motion of a sled of an auger boring machine along a track, refers to the direction away from the bore.

SUMMARY OF THE INVENTION

The invention comprises an auger boring machine which includes a track having an initial end and a terminal end, which track is provided with a rack. The auger boring machine also includes a sled that is mounted on the track and adapted to be moved between the initial end and the terminal end of the track. The sled includes a means for rotating an auger on the sled and a first drive system comprising a pinion which is mounted so as to engage with the rack on the track and means for rotating the pinion so as to drive the sled along the track.

In a preferred embodiment, the sled includes a conventional translation mechanism that drives the sled along the track while the cutting head is boring the bore for the casing. Preferably, a drive mechanism is provided for each side of the sled (and for each rail of the track). In various embodiments of the invention, the drive motor may be arranged to rotate the pinion about a horizontal axis or about a vertical axis.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
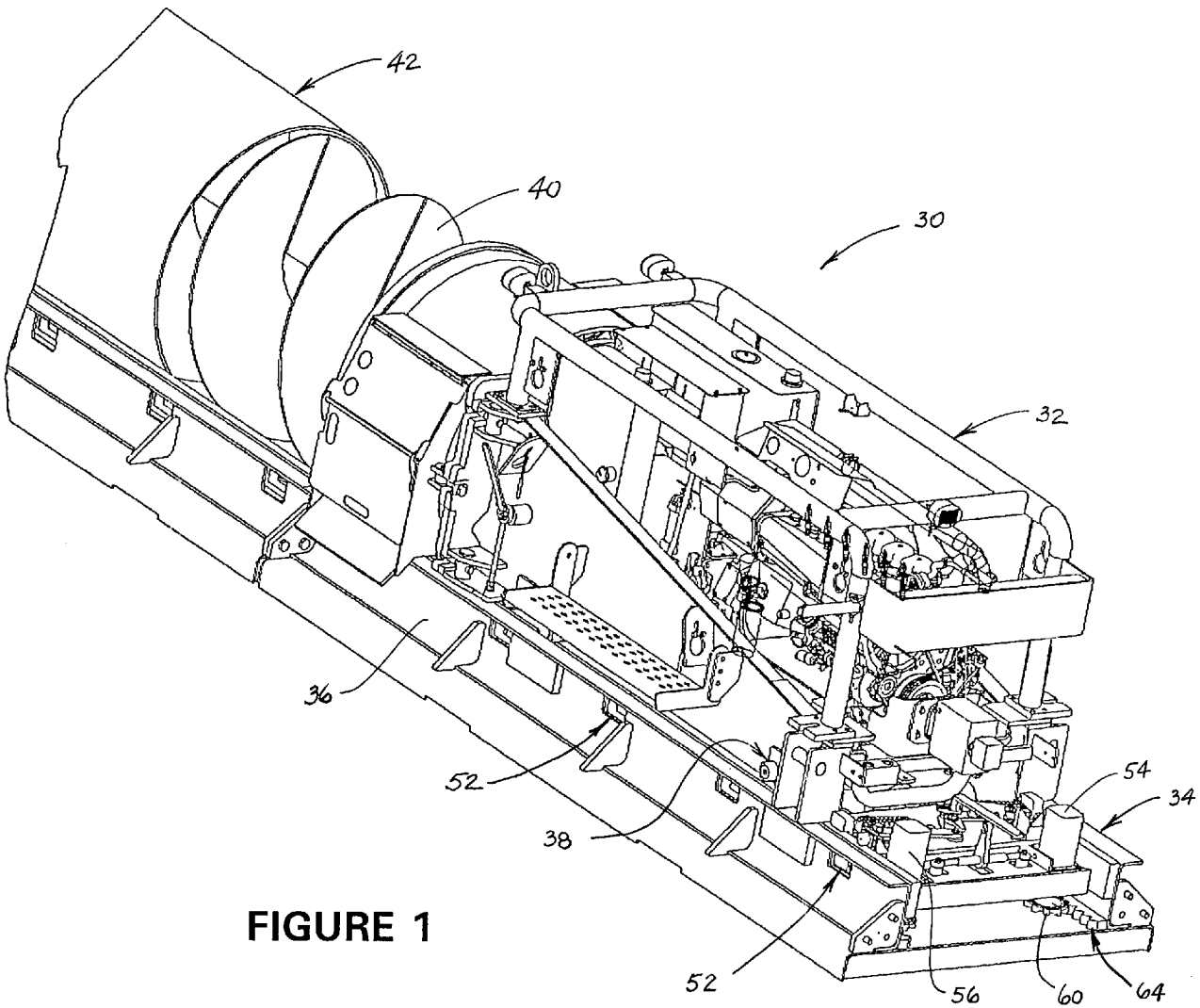
FIG. 1 is a rear perspective view of a preferred embodiment of the invention.
Figure 2:
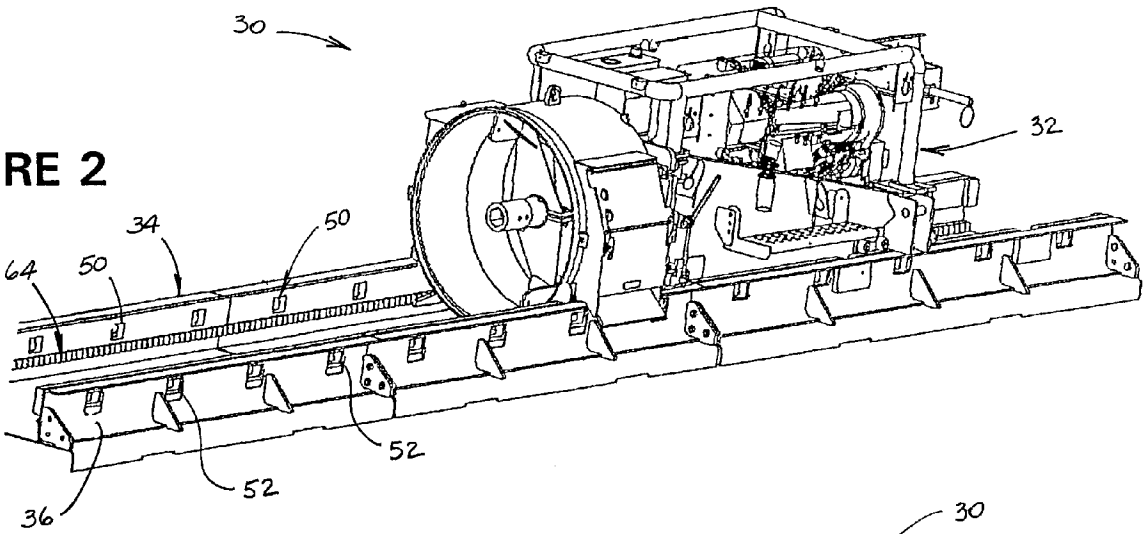
FIG. 2 is a front perspective view of the portion of the preferred embodiment of FIG. 1, but without the auger.
Figure 3:
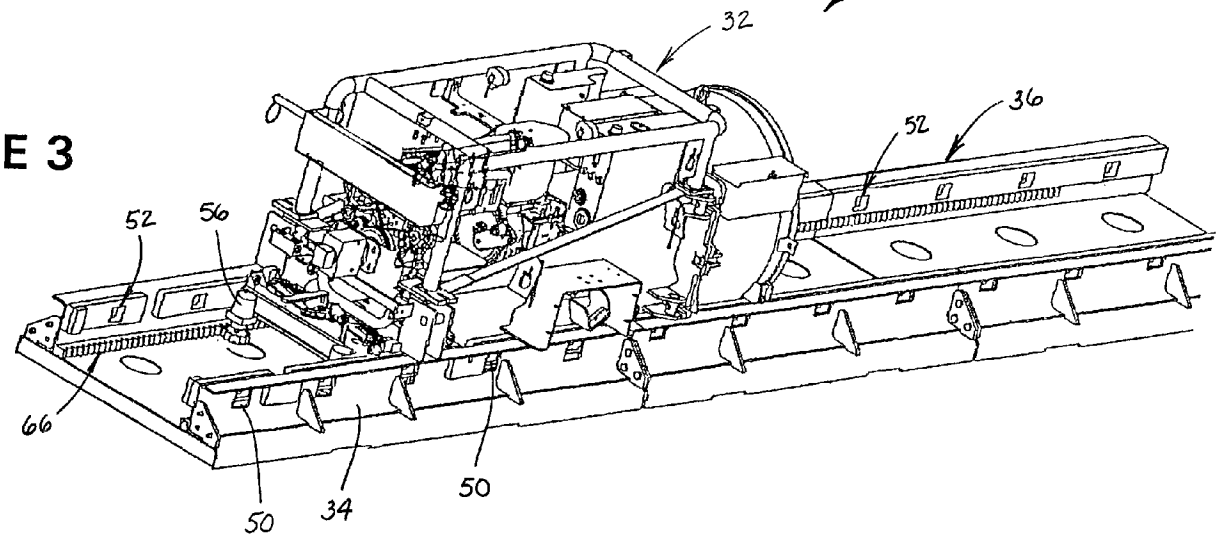
FIG. 3 is a rear perspective view of the portion of the preferred embodiment of the invention illustrated in FIG. 2.
Figure 4:
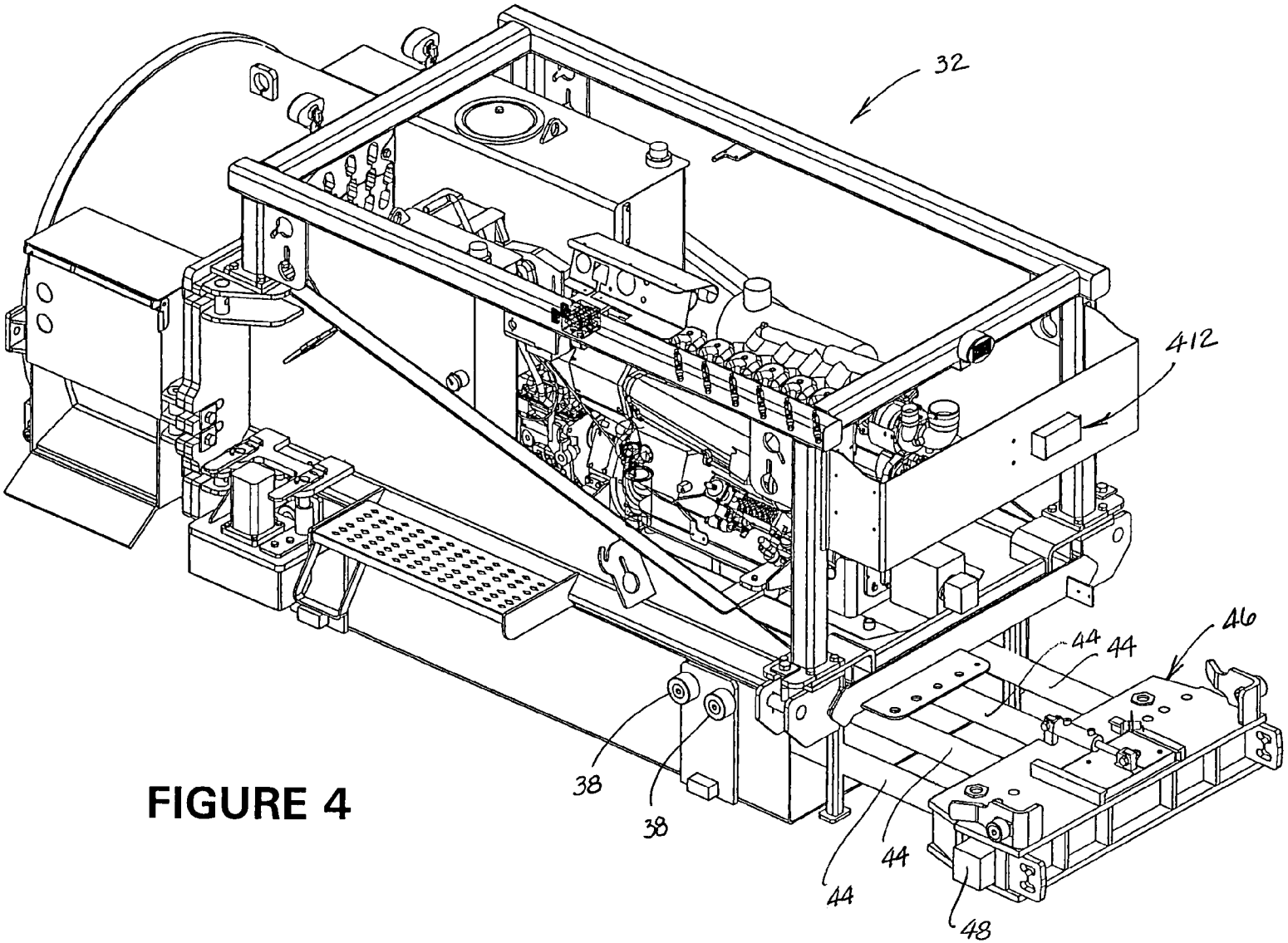
FIG. 4 is a rear perspective view of a portion of the preferred sled of the invention.
Figure 5:
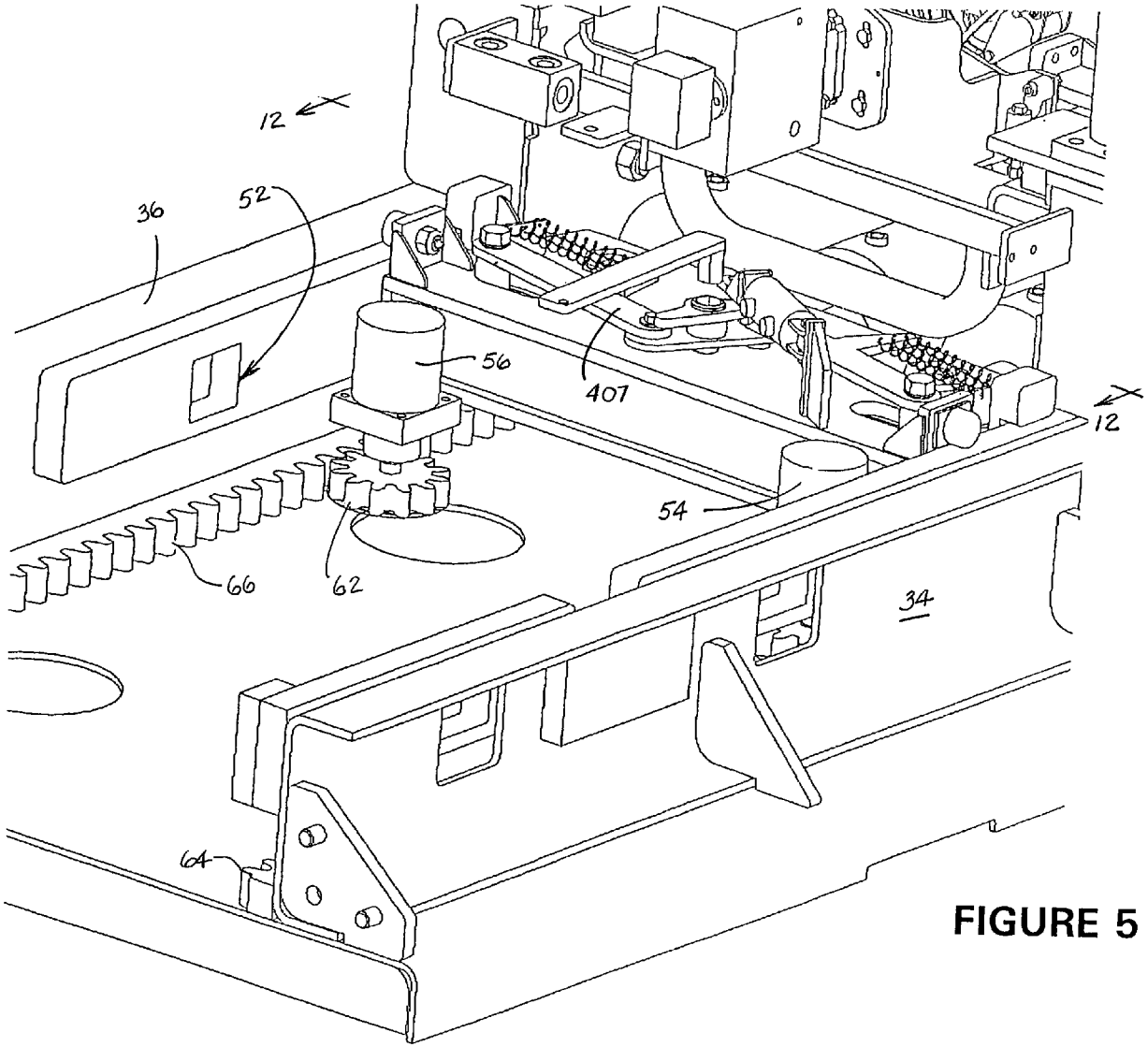
FIG. 5 is a rear perspective view of a portion of an alternative embodiment of the sled of the invention.

Referring now to the drawings, a preferred embodiment of the invention is illustrated in FIGS. 1–5. As shown therein, subterranean boring machine 30 includes a sled 32 that rolls along a track comprised of rails 34 and 36 by means of a plurality of rollers such as rollers 38. The sled includes a conventional cutting or boring mechanism that rotates a cutting head or auger 40 (see FIG. 1) in front of a section of casing 42 (also shown in FIG. 1) that is being installed. Sled 32 also includes a translation mechanism that drives the sled along the track while the cutting head is boring the bore for the casing. As shown in FIG. 4, this translation mechanism includes four hydraulic actuators 44 which move dog assembly 46 that includes a pair of push dogs, only one of which, dog 48 is shown. The push dogs are adapted to engage drive holes 50 in rail 34 and drive holes 52 in rail 36. In operation, the dogs engage a set of drive holes and the hydraulic actuators are extended to drive the sled in the boring direction. When the actuators have extended to their maximum length, the dogs are disengaged from the track and the actuators are fully retracted. Then the dogs engage a second set of drive holes and the actuators are extended to drive the sled another step in the boring direction. Although this embodiment of the invention includes four hydraulic actuators, other embodiments containing a single actuator or other convenient numbers and arrangements of actuators are also contemplated within the scope of the invention.

This embodiment of the invention includes a drive system which includes a pair of motors that are mounted at the rear end of the sled opposite the cutting mechanism. Although the motors may be electric motors, it is preferred that the motors be hydraulically operated, such as hydraulic motors 54 and 56 that are mounted on push bar 58 at the rear end of the sled. In this embodiment of the invention, the motors are arranged so that their shafts are oriented vertically, and a pair of pinions, including pinion 60 (shown in FIG. 1) and pinion 62 (shown in FIG. 3) on these shafts engage a pair of racks, including rack 64 (shown in FIG. 1) and rack 66 (shown in FIG. 3) that are mounted on the inside of rails 34 and 36, respectively, of the track.

Figure 6:
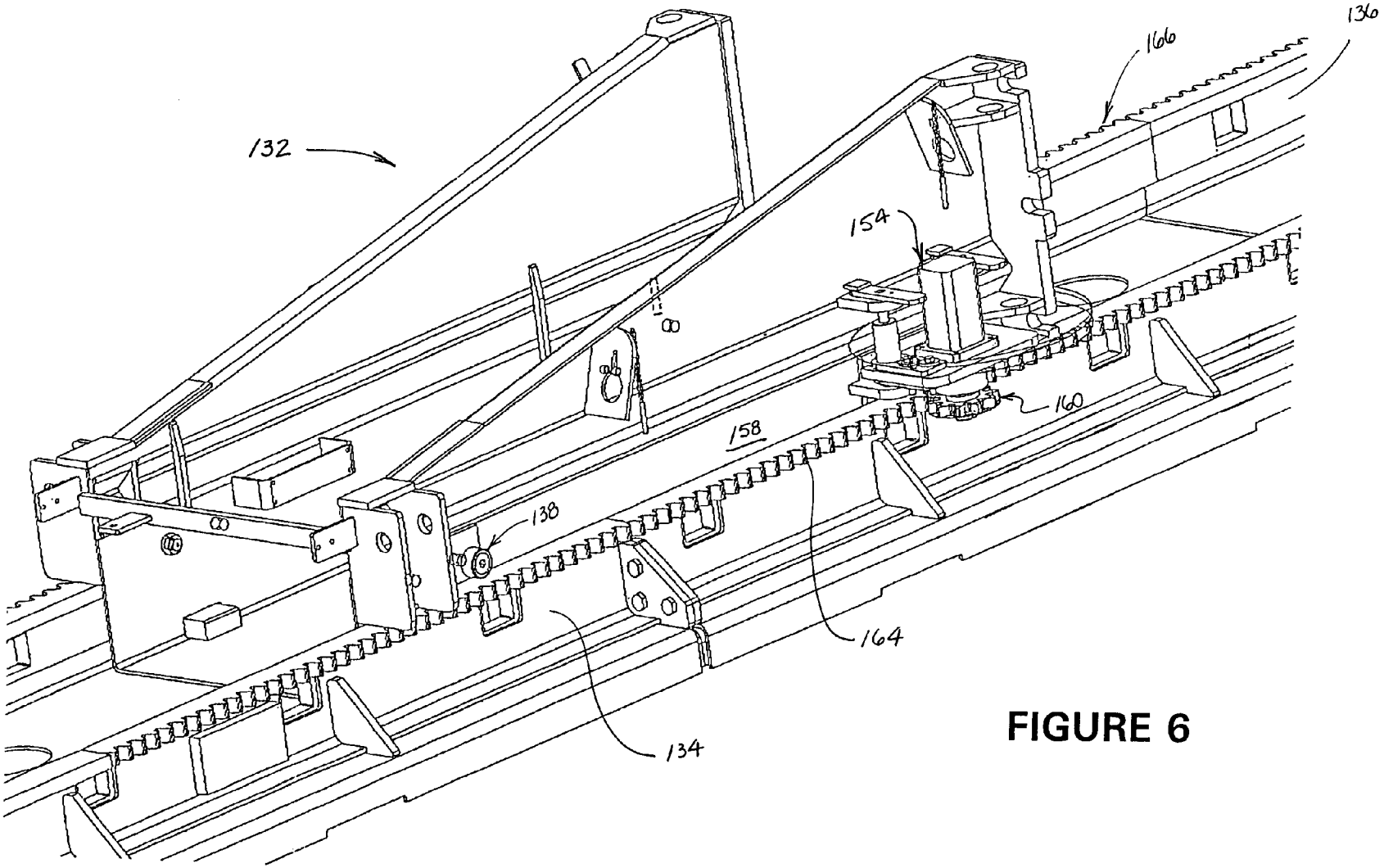
FIG. 6 is a perspective view of a portion of a sled showing the preferred embodiment of the drive system of the invention.

Another embodiment of the drive system of the invention is illustrated in FIG. 6. As shown therein, sled 132 is a part of a boring machine that rolls along a track comprised of rails 134 and 136 by means of a plurality of rollers such as rollers 138. The sled includes a conventional cutting or boring mechanism (such as that shown in FIGS. 1–4) that rotates a cutting head or auger (such as that shown in FIG. 1) in front of a section of casing that is being installed. Sled 132 also includes a translation mechanism (such as that shown in FIG. 4) that drives the sled along the track while the cutting head is boring the bore for the casing. This embodiment of the invention includes a drive system which includes a pair of hydraulic motors (only one of which, motor 154 is shown) that are mounted on the outer sides (such as side 158) of the sled. In this embodiment of the invention, the motors are arranged so that their shafts are oriented vertically, and a pair of pinions (including pinion 160) on these shafts engage a pair of racks 164 and 166 that are mounted on the outside of rails 134 and 136, respectively, of the track.

Figure 9:
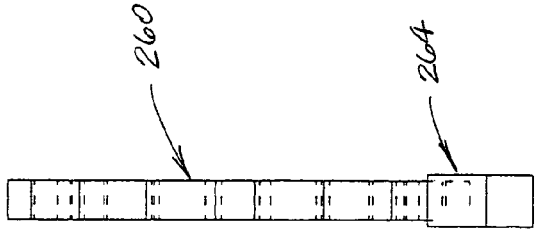
FIG. 9 is an end view of a pinion in engagement with a portion of the rack of the track of FIG. 7.
Figure 8:
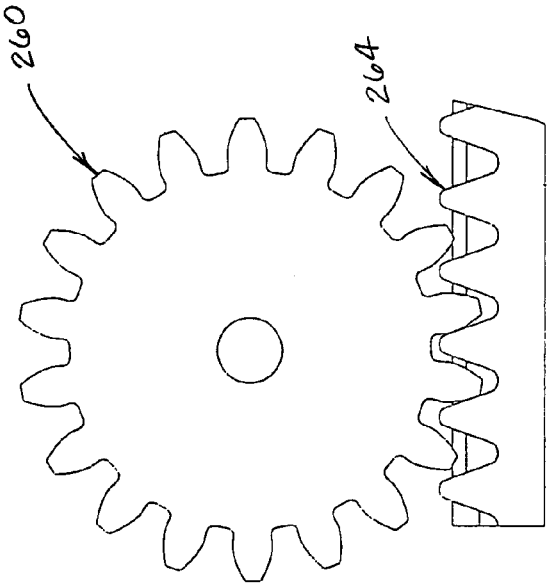
FIG. 8 is a side view of a pinion in engagement with a portion of the rack of the track of FIG. 7.
Figure 7:
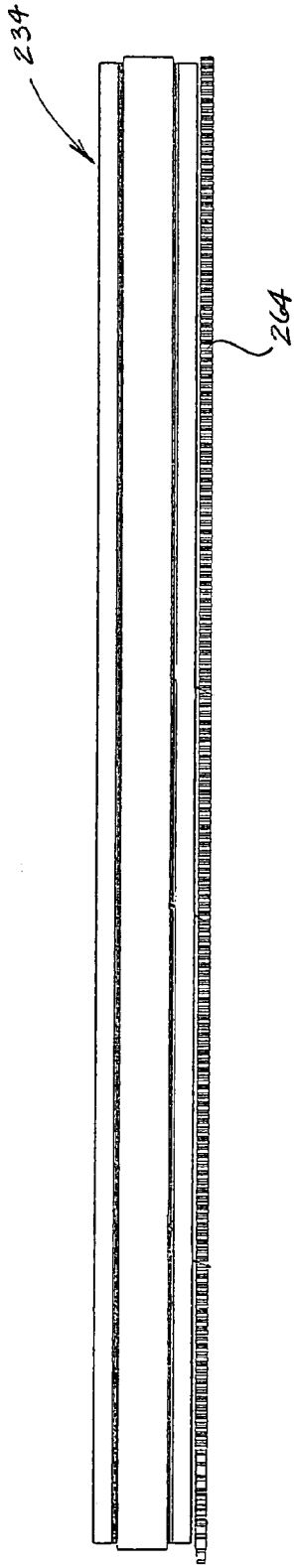
FIG. 7 is a top view of a track that is provided with a rack according to one embodiment of the invention.

Alternative types and arrangements of the racks and pinions of the drive system of the invention are illustrated in FIGS. 7–11. In FIGS. 7–9, a first embodiment is illustrated in which pinion 260 is mounted so as to rotate about a horizontal axis (not shown) while engaging rack 264 that is mounted on the side of rail 234. Rack 264 may be machined and therefore similar to rack 66 of FIG. 5, or it may be comprised of a series of round pins that are attached to the side of the track rail. The pins could be the pins of a roller chain such as a conveyor chain having flanges formed onto the side plates (not shown) for welding or otherwise attaching the chain to the track.

Figure 11:
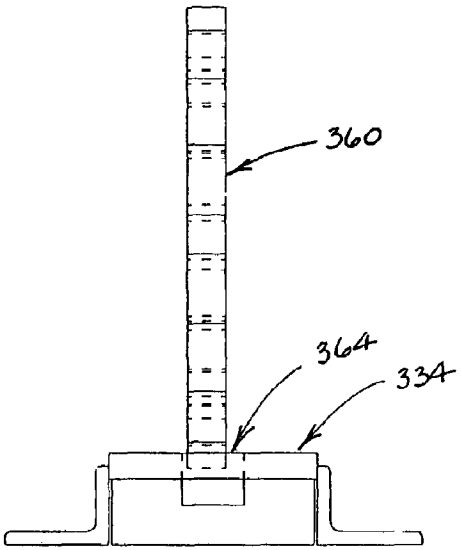
FIG. 11 is an end view of a pinion in engagement with a portion of the rack of the track of FIG. 10.
Figure 10:
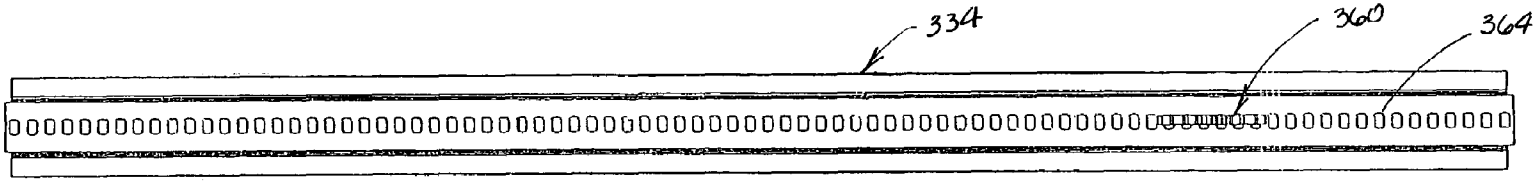
FIG. 10 is a top view of a track that is provided with a rack according to another embodiment of the invention.

FIGS. 10 and 11 illustrate a second embodiment in which pinion 360 engages rack 364, which is comprised of a series of round pieces of bar stock that are welded or otherwise attached along the top of rail 334. In a first alternative to this second embodiment, the round pieces of bar stock could be replaced with a chain (not shown) that is welded or otherwise attached along the top of the rail. In a second alternative to this second embodiment, pinion 360 could engage a series of holes or slots (also not shown) that are cut into the top of the rail.

According to a preferred embodiment of the invention, the drive system is provided with a control assembly that may be activated during operation of the translation mechanism to permit the pinion to rotate freely when the dog assembly is engaged with the track, and to act as a brake for the sled when the dog assembly is released from the track. When a boring machine equipped with a preferred drive system including hydraulic motors and the preferred control assembly is being operated to cut the bore, the pinions of the drive system will rotate freely with respect to the rack while forward motion or thrust is supplied by the translation mechanism. In this way, the rack and pinion of the drive system will not to interfere with the forward motion of the sled. However, when the dog assembly is not engaged with the track and the translation mechanism is being operated to reposition the dog assembly for engagement, the hydraulic motors of the drive system will be hydraulically locked so that the engagement of the pinions with the racks will act as a brake for the sled to inhibit backward movement of the sled along the track.

Figure 12:
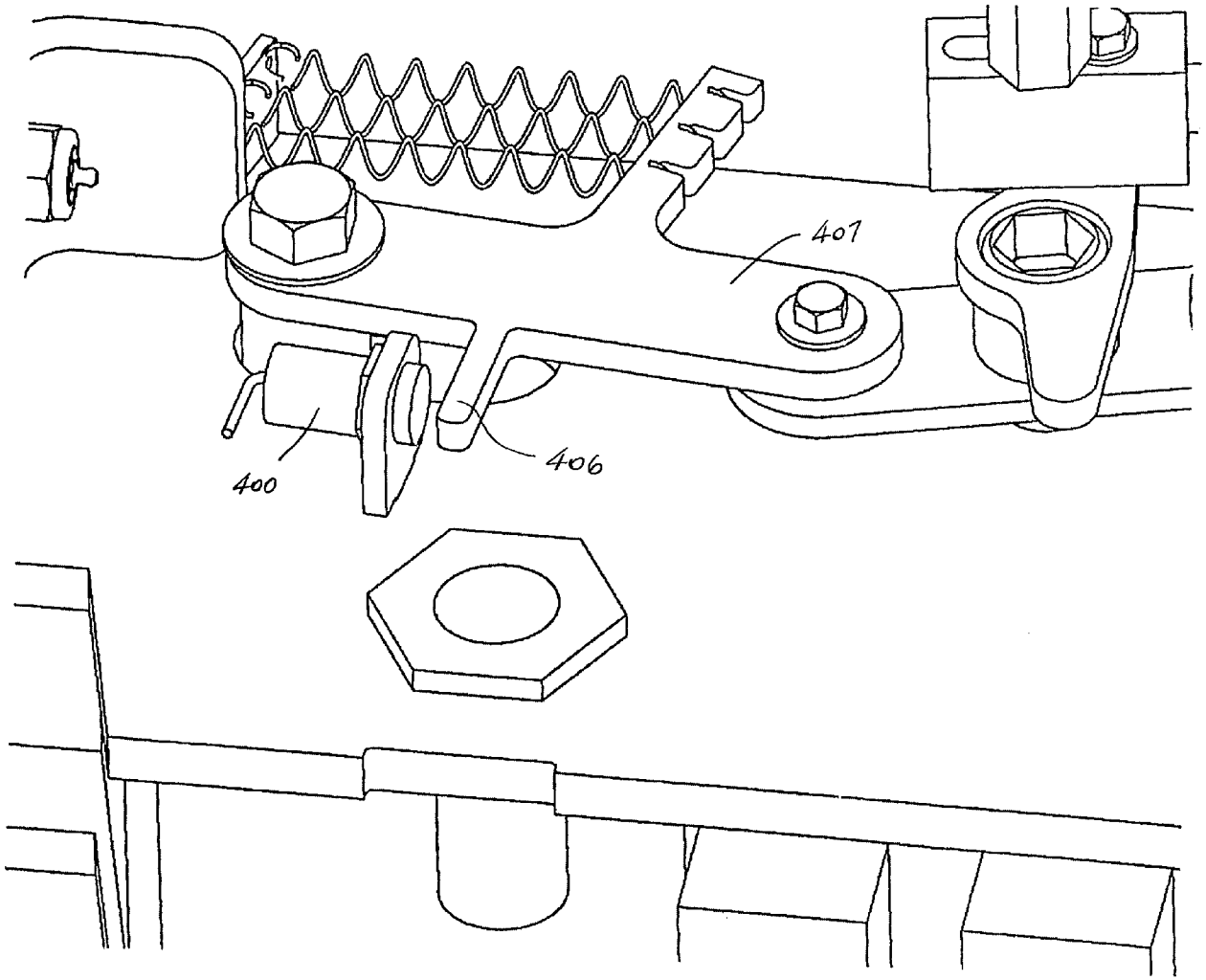
FIG. 12 is a partial perspective view taken along line 12—12 of FIG. 5 which illustrates the location of the proximity switch that is a part of a preferred control system for a preferred embodiment of the invention.
Figure 13:
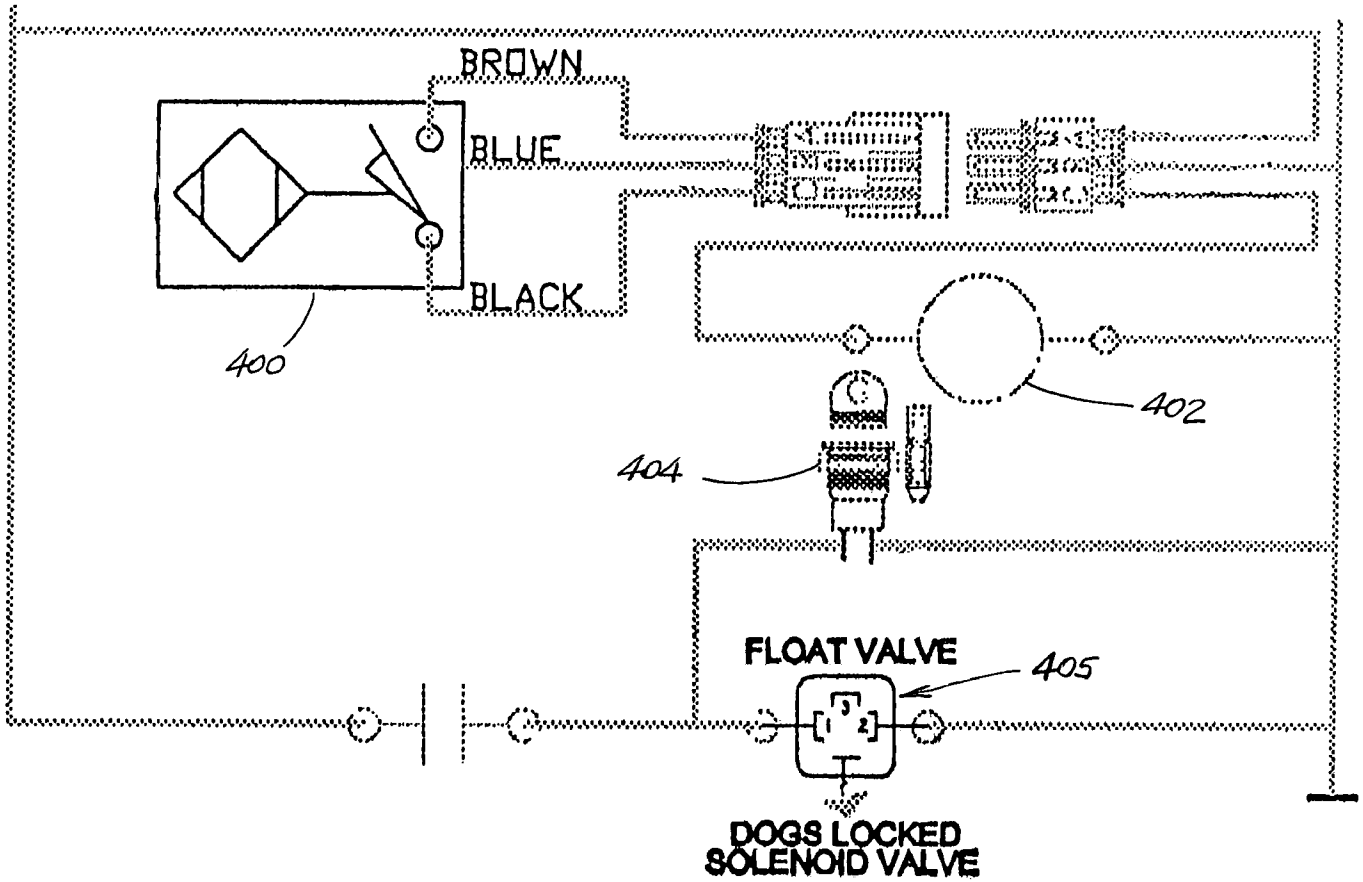
FIG. 13 is a schematic view of a portion of the electrical circuit for a preferred embodiment of the invention.
Figure 14:
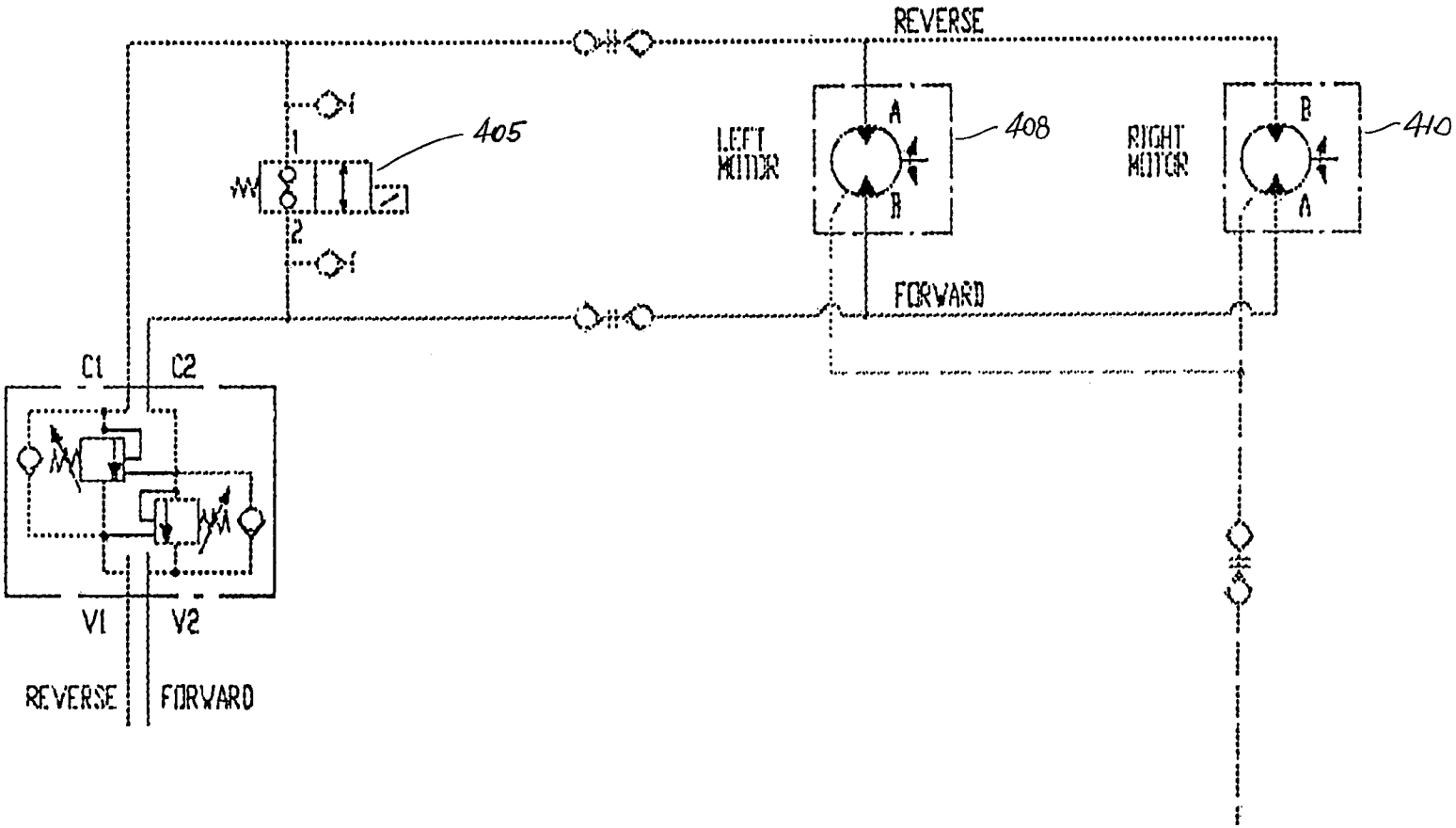
FIG. 14 is a schematic view of a portion of the hydraulic circuit for a preferred embodiment of the invention.

This preferred control system includes proximity switch 400 (see FIGS. 12 and 13), as well as electrical and hydraulic circuitry. As shown in FIG. 13, proximity switch 400 controls contact relay 402, which in turn controls solenoid 404 on hydraulic float valve 405. When the proximity switch senses the proximity of linkage arm 406 of dog link 407 (shown in FIGS. 5 and 12), which will occur any time the dogs, such as dog 48 of sled 32 of FIG. 4, are completely engaged into a pair of holes of the track, the proximity switch opens the normally closed float valve. As shown in FIG. 14, float valve 405 controls whether hydraulic oil is circulated from port "A" to port "B" or from port "B" to port "A" of hydraulic motors 408 and 410, or if the flow of hydraulic oil is blocked. When float valve 405 is opened, the oil will circulate from port "A" to port "B" and allow the pinions on the shafts of the hydraulic motors to freely turn. When the dogs start to disengage from the holes in the track, dog linkage arm 406 moves out of proximity with switch 400 (to the right as shown in FIG. 12), and the proximity switch de-energizes contact relay 402 and solenoid 404. With the solenoid de-energized on float valve 405, the valve will close and stop the flow of hydraulic oil from port "A"

to port "B" on the hydraulic drive motors. When this occurs, the only way for the pinions to turn is by pushing the oil over counterbalance valve 412 (shown in FIG. 4). The counterbalance valve then serves as a braking device to help keep the sled from rolling on the track when the dogs are disengaged from the holes in the track. Because the proximity switch senses its proximity to the dog linkage arm, and because the actuators of the preferred translation mechanism are retracted when the drive system is engaged, the preferred control system will not be activated when the drive system is in use.

Figure 15:
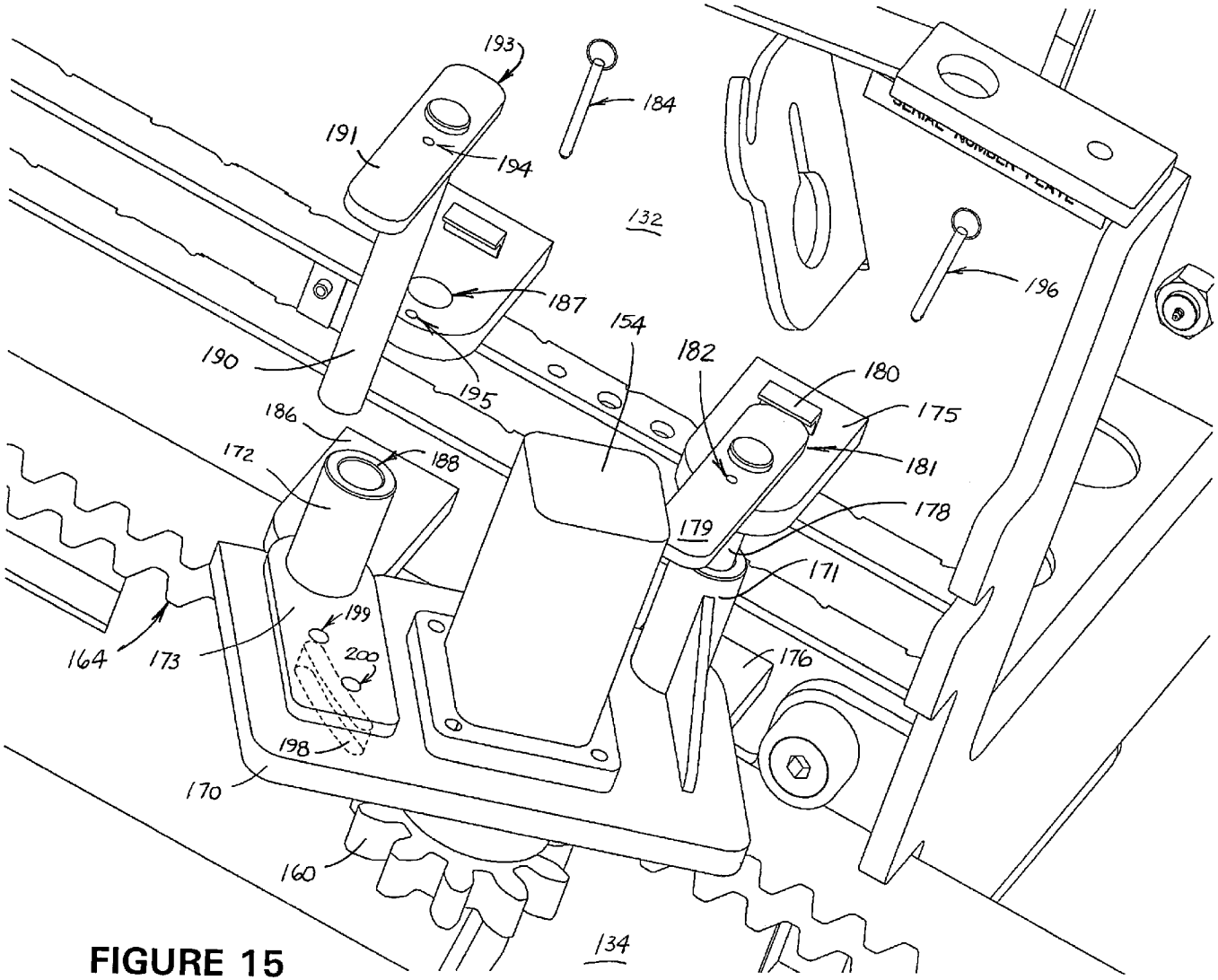
FIG. 15 is a perspective view of a portion of the drive system of the preferred embodiment of the invention which illustrates a first engagement adjustment mechanism to permit alignment of the pinion with the rack.

A preferred embodiment of the invention includes a pair of engagement adjustment mechanisms to ensure that the pinions of the drive system easily and accurately engage with their associated racks. One such engagement adjustment mechanism is illustrated in FIGS. 6 and 15–17. As shown in FIG. 15, preferred hydraulic motor 154 is mounted on motor mounting plate 170 (preferably by being bolted thereon) so that shaft 157 of the motor (see FIGS. 16–18) extends through a shaft hole in the plate (not shown). Pinion 160 is mounted on shaft 157 on the lower side of plate 170 (see also FIGS. 16 and 17). In this embodiment of the invention, pivot cylinder 171 is fixedly mounted on one side of motor 154 through a pivot cylinder hole (not shown) in motor mounting plate 170 (see also FIGS. 16 and 17). Pivot cylinder 172 is mounted on the other side of motor 154 from cylinder 171 through a pivot cylinder hole (not shown) in upper cylinder plate 173, pivot cylinder slot 197 (shown in FIG. 18) in motor mounting plate 170 and a pivot cylinder hole (not shown) in lower cylinder plate 174 (see also FIGS. 16 and 17). As discussed in more detail hereinafter in connection with a description of FIG. 18, pivot cylinder 172 is preferably mounted in slot 197 in such a manner as to permit some adjustment in its relative position on plate 170. Attached to the side of sled 132 (preferably by being welded thereon) are upper pivot plate 175 and lower pivot plate 176. A pivot hole (not shown) in upper pivot plate 175 is aligned with a central hole in cylinder 171 (also not shown) and pivot hole 177 in lower pivot plate 176 (see FIGS. 17 and 18), so that rotation pin 178 may be placed through the pivot hole in upper pivot plate 175, through the central hole in cylinder 171 and into pivot hole 177 in lower pivot plate 176, so as to pivotally attach motor mounting plate 170 to sled 132 about rotation pin 178. Pin 178 has a fixed top plate 179 mounted at its upper end, and upper pivot plate 175 is preferably provided with a keeper bracket 180 which is adapted to engage with end 181 of top plate 179 to keep rotation pin 178 from moving out of the hole in cylinder 171, unless top plate 179 is rotated so that end 181 clears keeper bracket 180. However, for additional security, hole 182 in top plate 179 may be aligned with hole 183 (see FIGS. 16 and 17) in upper pivot plate 175 and anti-rotation pin 184 placed therethrough. When anti-rotation pin 184 is fully engaged in holes 182 and 183, top plate 179 cannot be rotated out of engagement with keeper bracket 180.

Upper pivot plate 185 and lower pivot plate 186 are also attached to the side of sled 132 in a manner similar to that of upper pivot plate 175 and lower pivot plate 176. Pivot hole 187 in upper pivot plate 185 is aligned with hole 188 in cylinder 172 and pivot hole 189 (see FIG. 16) in lower pivot plate 186, so that rotation pin 190 may be placed through pivot hole 187 in upper pivot plate 185, through hole 188 in cylinder 172 and into pivot hole 189 in lower pivot plate 186, so as to pivotally attach motor mounting plate 170 to sled 132 about rotation pin 190. Pin 190 has a fixed top plate 191 mounted at its upper end, and upper pivot plate 185 is preferably provided with a keeper bracket 192 which is adapted to engage with end 193 of top plate 191 to keep pin 190 from moving out of hole 188 in cylinder 172, unless top plate 191 is rotated so that end 193 clears keeper bracket 192. However, for additional security, hole 194 in top plate 191 may be aligned with hole 195 in upper pivot plate 185 and anti-rotation pin 196 placed therethrough. When anti-rotation pin 196 is fully engaged in holes 194 and 194, top plate 191 cannot be rotated out of engagement with keeper bracket 192.

Figure 16:
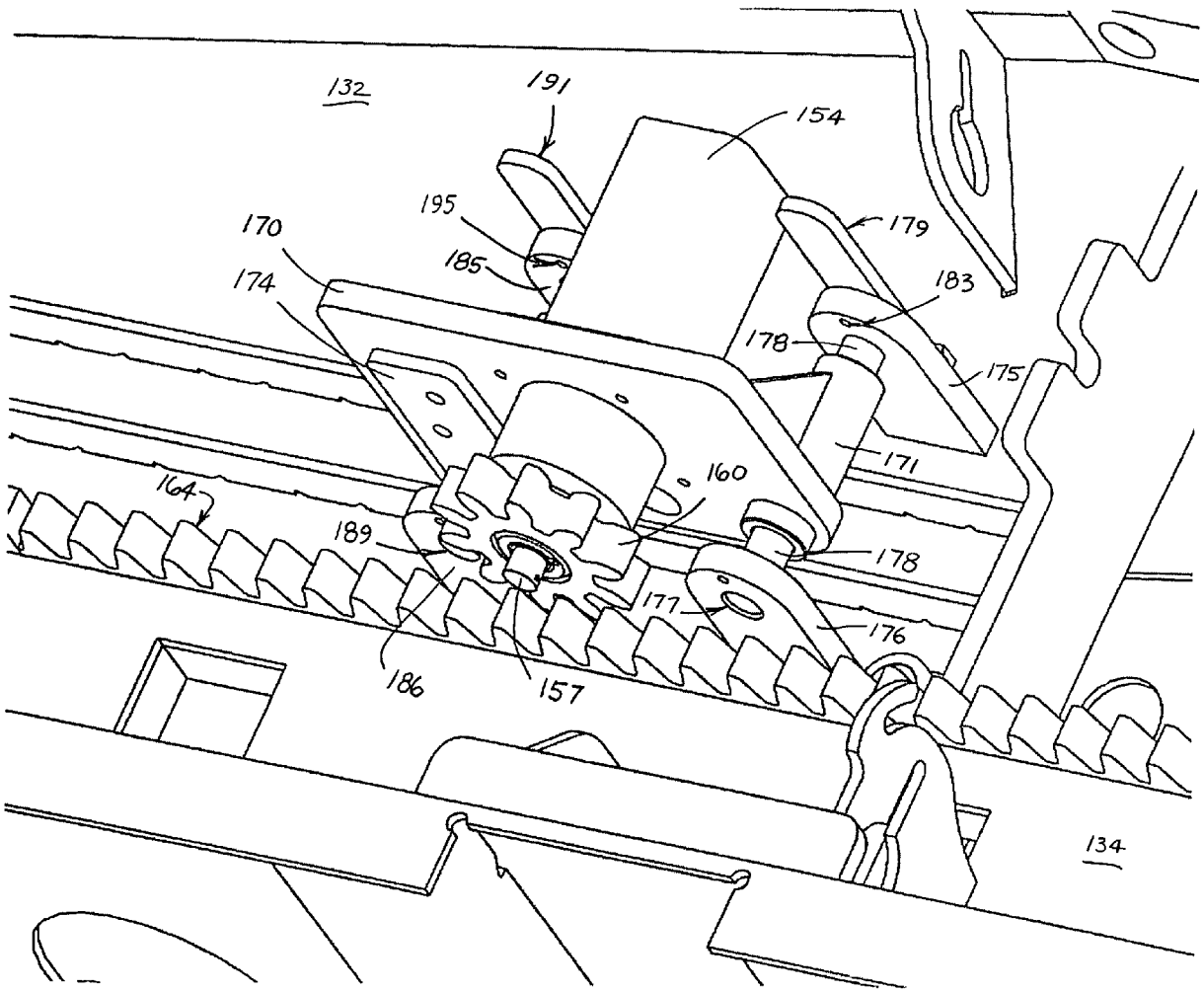
FIG. 16 is a perspective view of a portion of the drive system of the embodiment of FIG. 15 which illustrates a safety feature of the first engagement adjustment mechanism, showing the pinion and rack out of alignment and the drive assembly vertically displaced.
Figure 17:
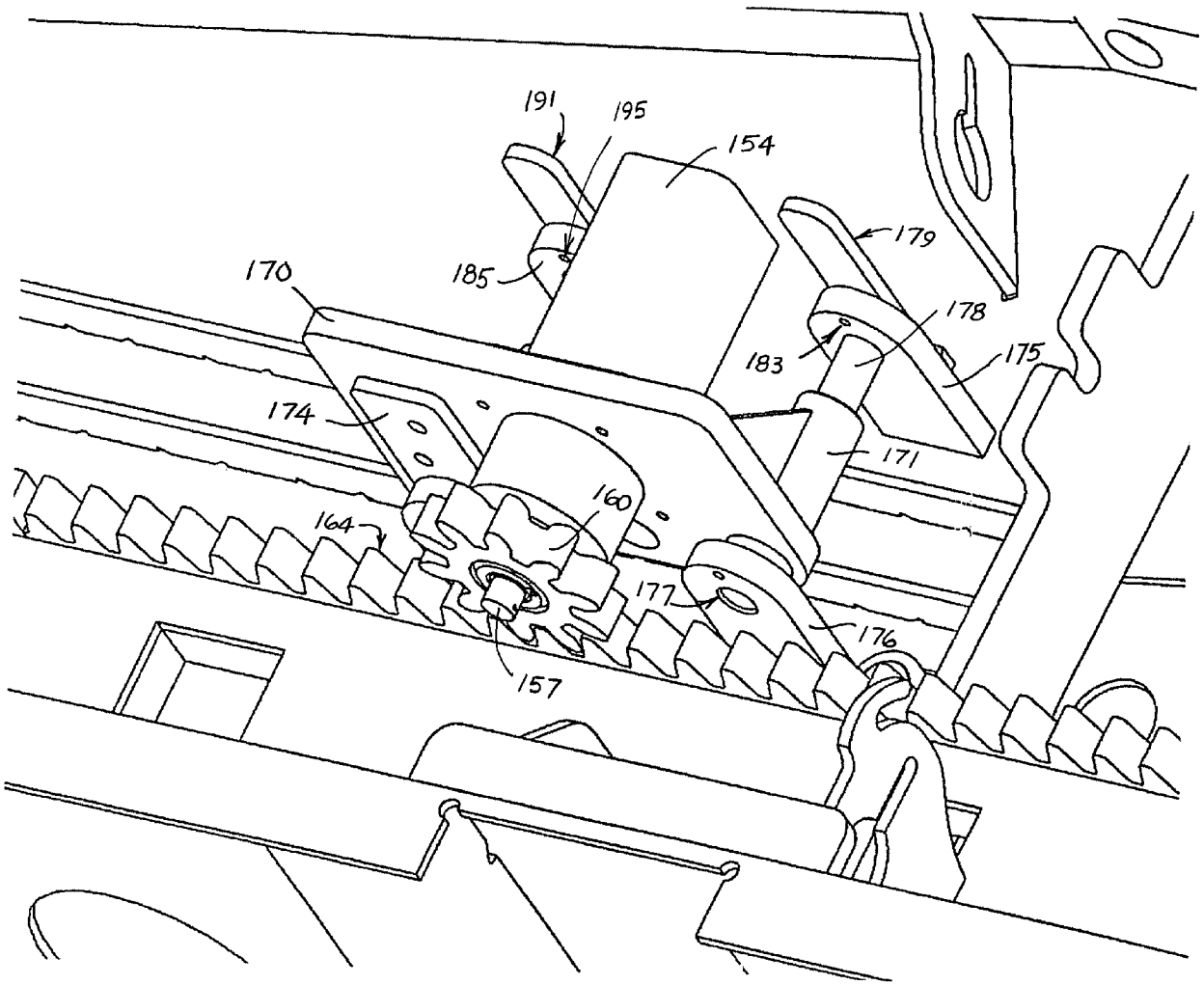
FIG. 17 is a perspective view of a portion of the drive system of the embodiment of FIGS. 15 and 16, showing the pinion and rack in alignment.

FIGS. 16 and 17 illustrate a safety feature inherent in the engagement means of FIG. 15. If sled 132 is placed onto a track which includes rail 134 in such a manner that pinion 160 does not mesh with rack 164 (as shown in FIG. 16), the relative placement of upper pivot plates 175 and 185, and lower pivot plates 176 and 186, the length of cylinders 171 and 172, and the length of pins 178 and 190 are such that motor mounting plate 170 may move upwardly to allow pinion 160 to rest atop rack 164. In such event, one of the anti-rotation pins (such as anti-rotation pin 196) may be removed, the corresponding top plate (such as top plate 191) may be pivoted to disengage from its keeper bracket (such as keeper bracket 192), and the rotation pin (such as rotation pin 190) may be removed to allow the pinion to swing outward in order to clear the rack. Then, pinion 160 may be turned to permit it to engage with rack 164 and motor mounting plate pivoted back towards sled 132 to permit the rotation pin that was removed to be replaced with the rack and pinion in proper mesh, as shown in FIG. 17.

Figure 18:
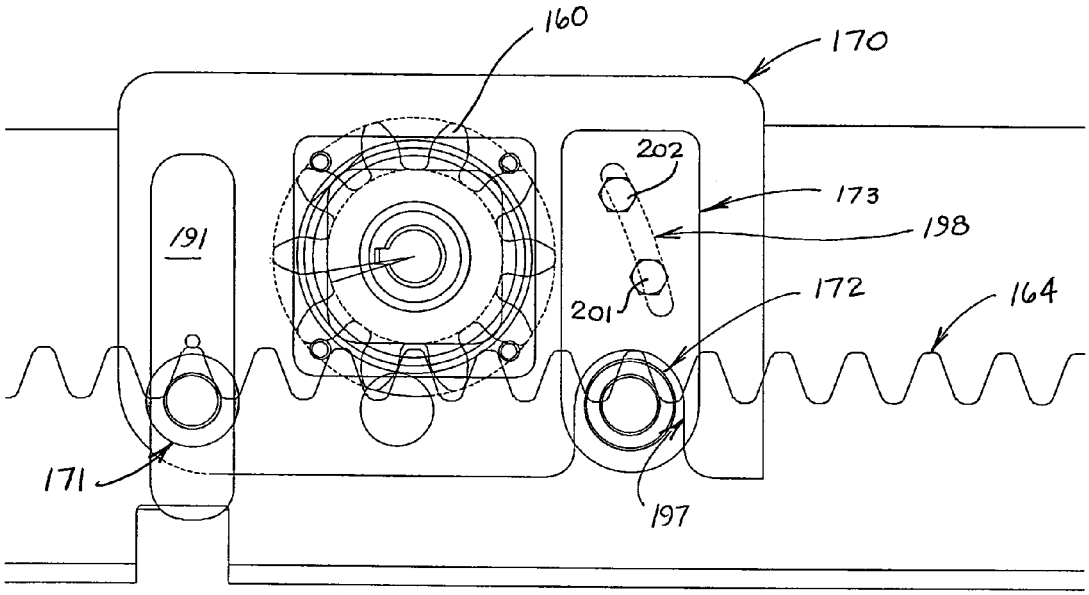
FIG. 18 is a top view of a portion of the drive system of a preferred embodiment of the invention which illustrates a second engagement adjustment mechanism to permit alignment of the pinion with the rack.

FIGS. 15 and 18 illustrate a second engagement adjustment mechanism that is adapted to ensure that the pinions of the drive system easily and accurately engage with their associated racks by providing means for adjustably mounting the second pivot cylinder in a plurality of positions in the slot in the motor mounting plate. As shown therein, upper cylinder plate 173 and lower cylinder plate 174 are rigidly mounted onto pivot cylinder 172 with motor mounting plate 170 therebetween. Motor mounting plate 170 is provided with slot 197 that is adapted to receive pivot cylinder 172 and with slot 198 that is preferably curved along a radius about the center of pin 178. Upper cylinder plate 173 is provided with holes 199 and 200 which are aligned with corresponding holes (not shown) in lower cylinder plate 174. Pivot cylinder 172 may be located in a desired location within slot 197 and pins 201 and 202 (which may be bolts or screws) may be aligned with holes 199 and 200 and with the corresponding holes in lower cylinder plate 174, so that these pins may be inserted through holes 199 and 200, through slot 198 in the motor mounting plate and into the aligned holes in lower cylinder plate 174 to fix the location of pivot cylinder 172 with respect to the motor mounting plate, thereby providing a second adjustment mechanism for insuring proper alignment of pinion 160 with rack 164.

Figure 19:
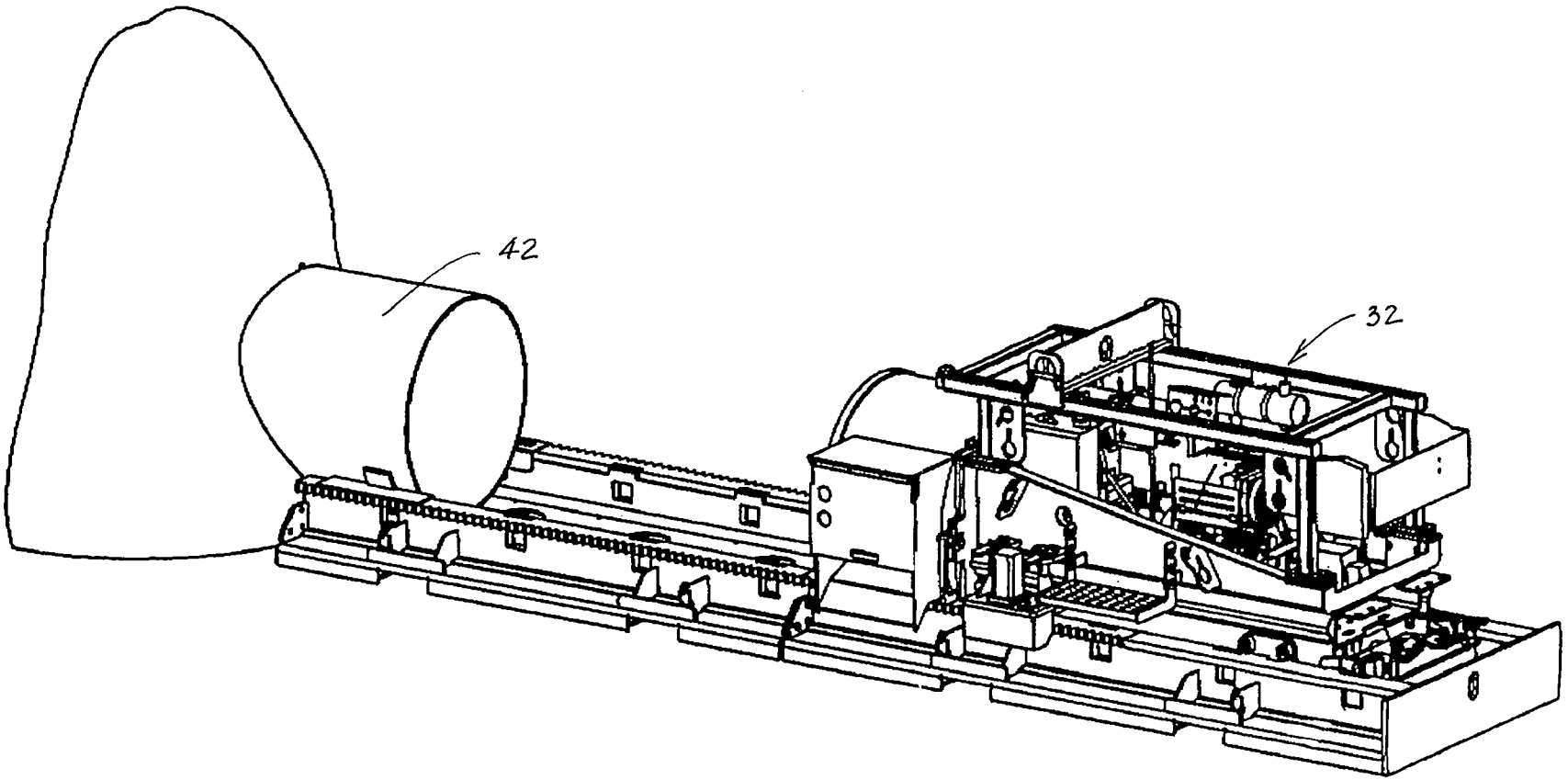
FIG. 19 is a perspective view of a preferred embodiment of the invention which illustrates how the drive system of the invention can be used to move the sled along the track in either direction for various purposes but without being connected to an auger section or a section of casing.
Figure 20:
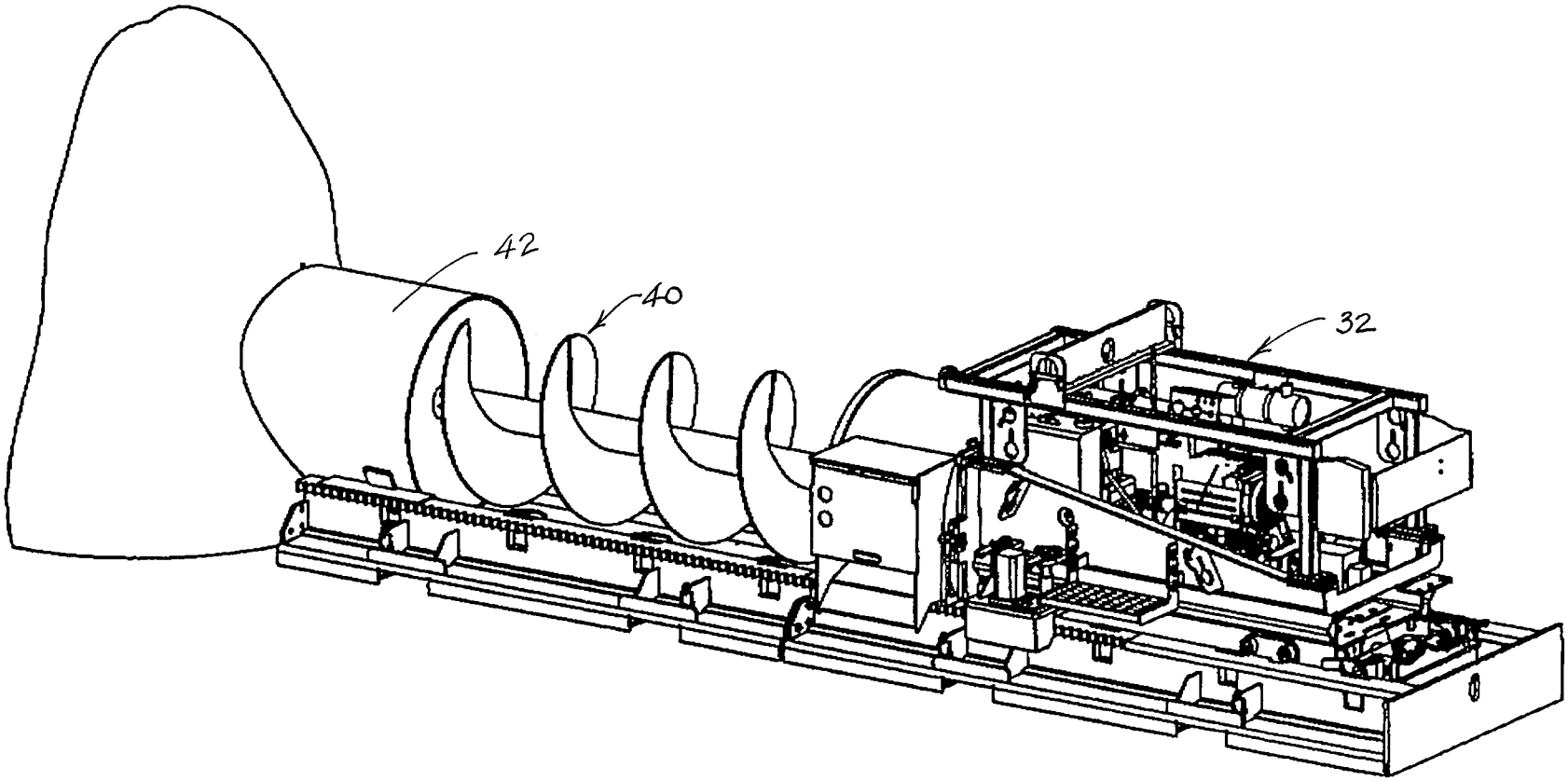
FIG. 20 is a perspective view of a preferred embodiment of the invention which illustrates how the drive system of the invention can be used to move the sled along the track in either direction to push or pull the auger.
Figure 21:
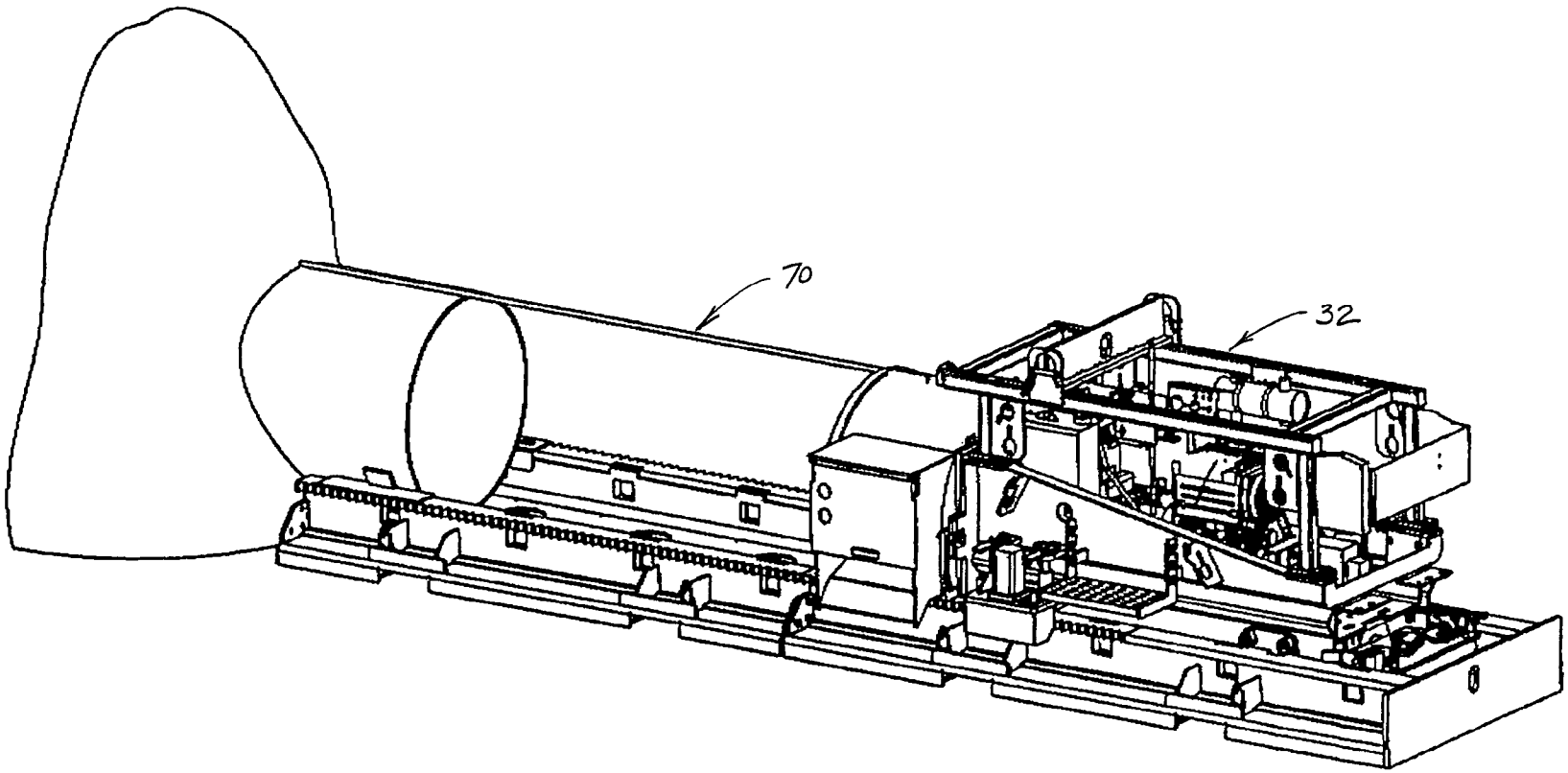
FIG. 21 is a perspective view of a preferred embodiment of the invention which illustrates how the drive system of the invention can be used to move the sled along the track in order to pull steering rods from the bore.
Figure 22:
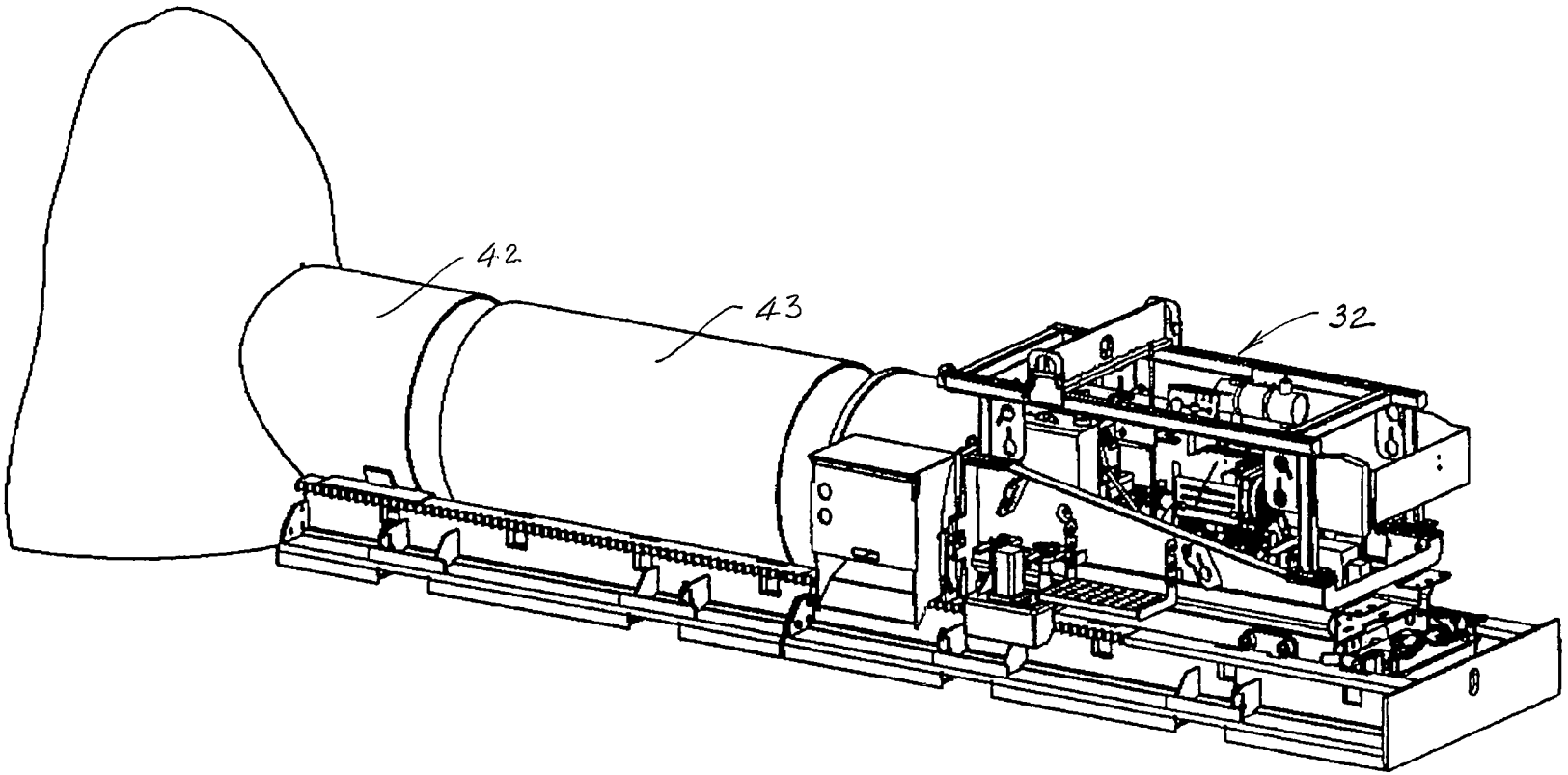
FIG. 22 is a perspective view of a preferred embodiment of the invention which illustrates how the drive system of the invention can be used to move the sled along the track in the forward direction to mate a newly added section of casing with a previously installed section of casing.
Figure 23:
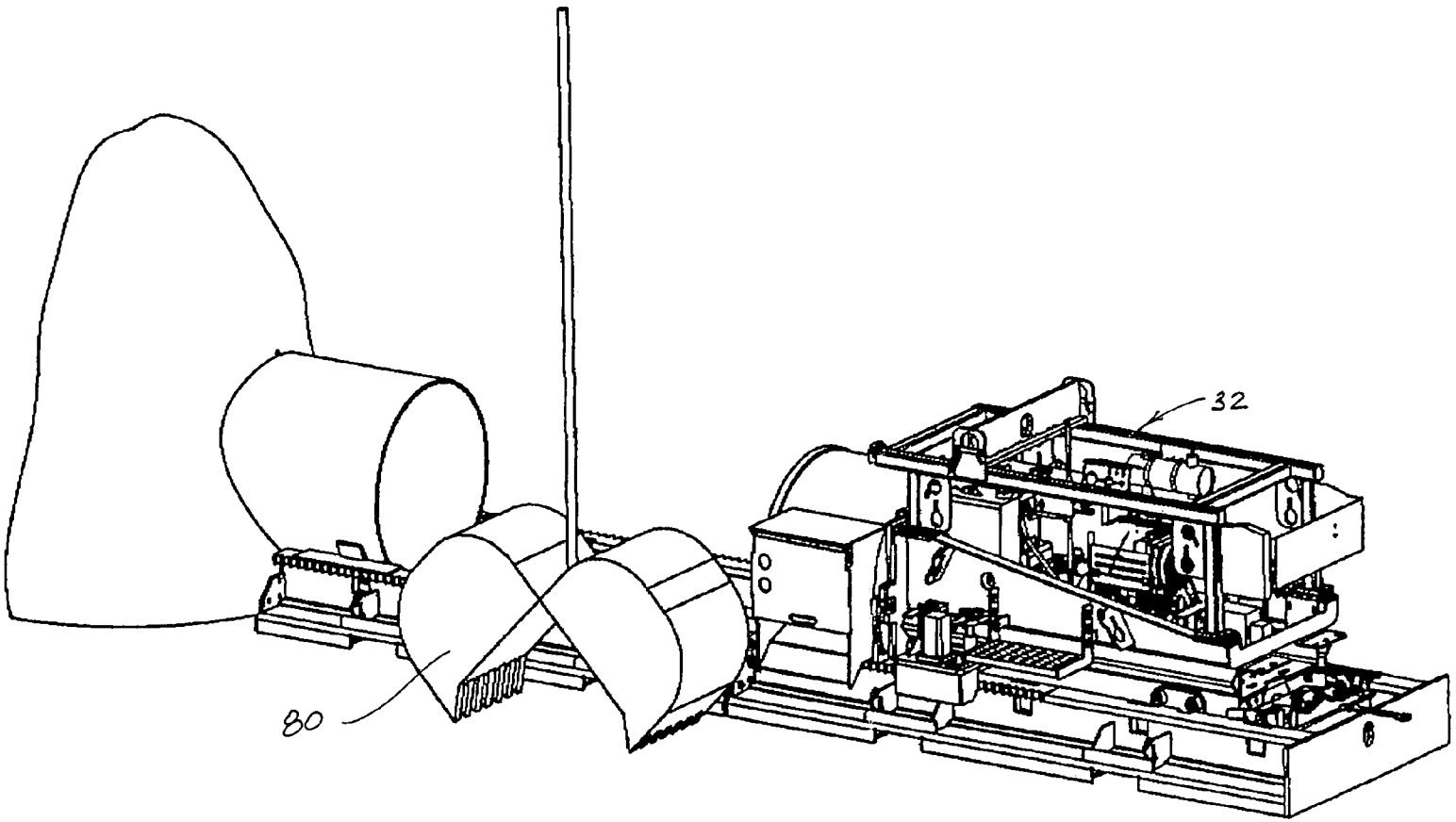
FIG. 23 is a perspective view of a preferred embodiment of the invention which illustrates how the drive system of the invention can be used to move the sled along the track to allow a bucket gain better access to the cuttings in order to remove them from the pit.
Figure 24:
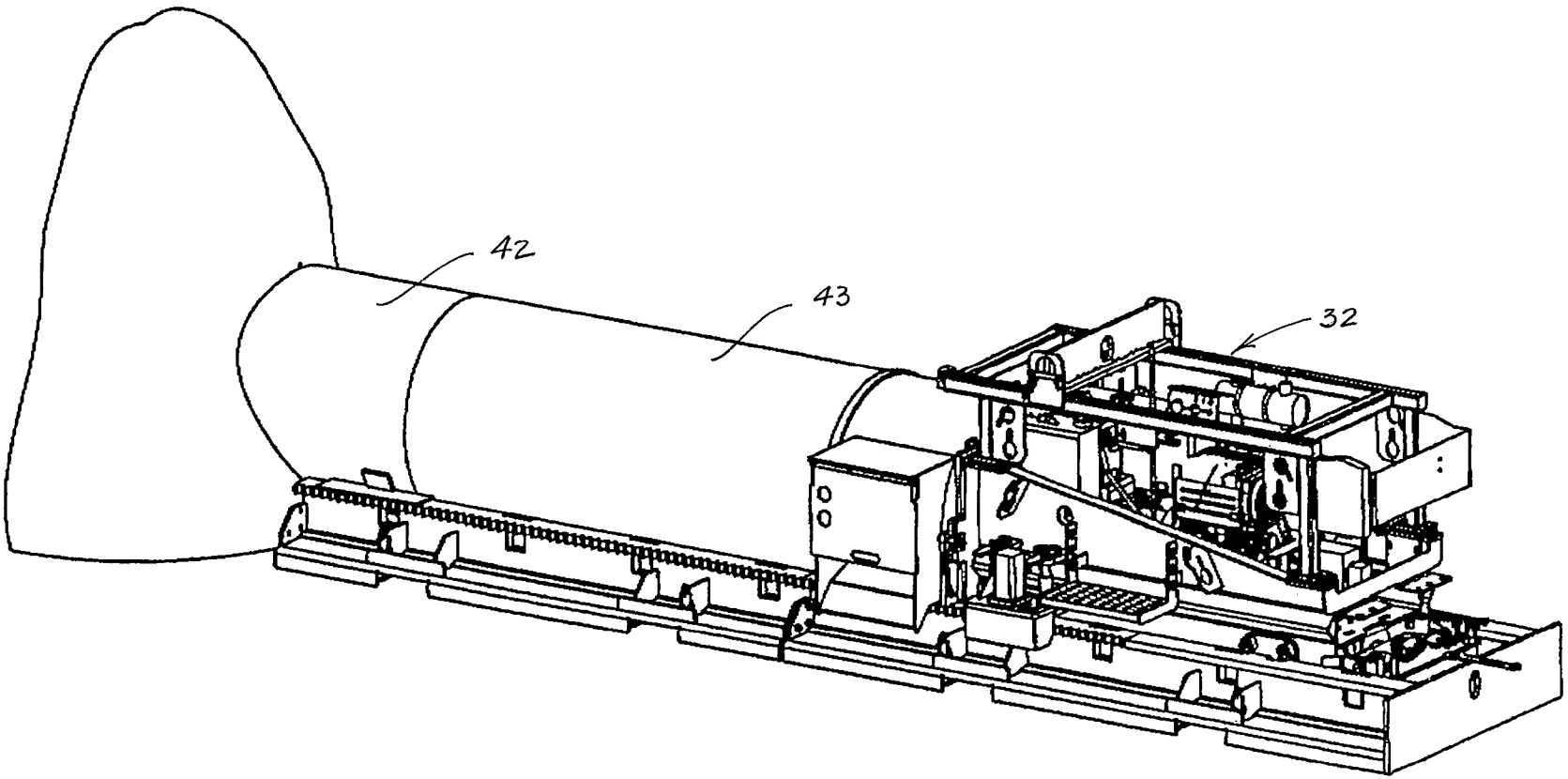
FIG. 24 is a perspective view of a preferred embodiment of the invention which illustrates how the drive system of the invention can be used to move the sled along the track in the rearward direction to reposition the casing.
Figure 25:
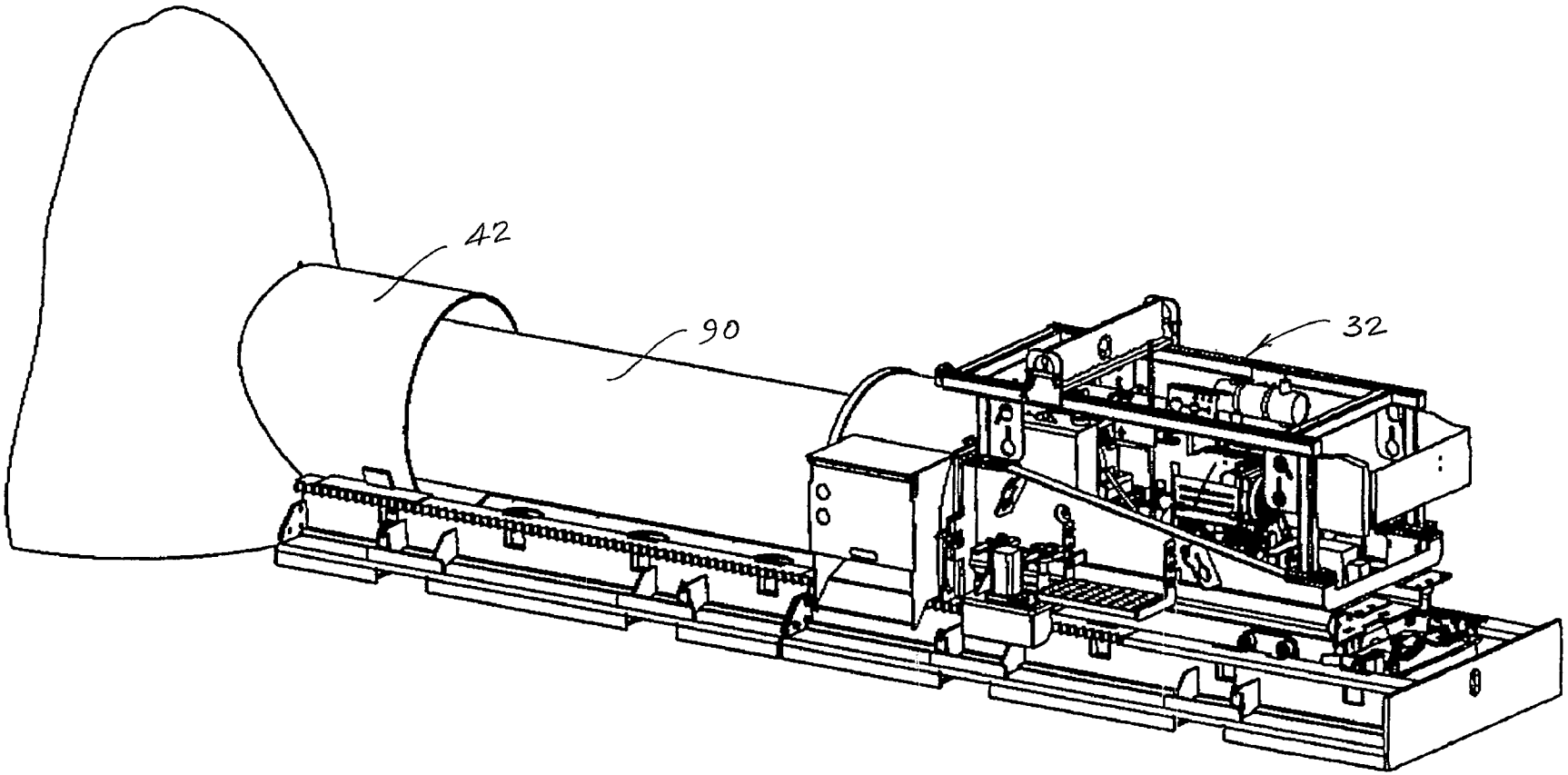
FIG. 25 is a perspective view of a preferred embodiment of the invention which illustrates how the drive system of the invention can be used to move the sled along the track in the forward direction to place a utility product into the casing.

FIGS. 19–25 illustrate the versatility of the drive system of the invention. As shown in FIG. 19, the drive system may be employed to move sled 32 along the track in the backward direction to pull an auger section (not shown), or in either or both of the forward and backward directions to prepare to add a casing section (also not shown) to section 42 or to align the push dogs with the track holes. FIG. 20 illustrates how the drive system may be employed to move sled 32 along the track in either the forward or the backward direction to prepare to place auger section 40 into casing section 42 for boring. FIG. 21 shows how the drive system may be employed to move sled 32 along the track in the backward direction to remove steering rods, such as rod 70, from the bore. FIG. 22 shows how the drive system may be employed to move sled 32 along the track in the forward and/or backward directions to mate the sled with an additional section of casing 43, which typically includes a section of auger (not shown), to be installed adjacent to casing section 42. FIG. 23 shows how the drive system may be employed to move sled 32 along the track in either the forward or the backward direction to allow bucket 80 access to the side of the track for removal of cuttings from the auger operation. FIG. 24 shows how the drive system may be employed to move sled 32 along the track in the backward direction to pull casing 43 to reposition it with respect to casing 42. FIG. 25 shows how the drive system may be employed to move sled 32 along the track in the forward direction to place an underground utility product, such as plastic or steel pipe 90 within casing 42.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations as would be understood by those having ordinary skill in the art to which the invention relates, and the same are intended to be comprehended within the meaning and range of equivalents of the appended claims.

What is claimed is:

1. An auger boring machine comprising:

(a) a track having an initial end and a terminal end, said track being provided with a rack;

(b) a sled that is mounted on the track and adapted to be moved between the initial end of the track and the terminal end thereof;

(c) means for rotating an auger on the sled;

(d) a drive system comprising:

(i) a pinion which is mounted so as to engage with the rack on the track;

(ii) means for rotating the pinion so as to drive the sled along the track.

2. The machine of claim 1 which includes an engagement adjustment mechanism by which a misaligned pinion may be brought into alignment with an associated rack.

3. The machine of claim 1 which includes:

(a) a motor mounting plate, said plate having:

(i) an upper side; and (ii) a lower side; and (iii) a motor shaft hole therethrough;

(b) a motor having a shaft, said motor being mounted on the upper side of the motor mounting plate so that the shaft extends through the motor shaft hole;

(c) a pinion that is mounted on the shaft and disposed on the lower side of the motor mounting plate, said pinion being adapted to engage with the rack on the track;

(d) means for pivotally attaching the motor mounting plate to the sled, so that the motor mounting plate may be pivoted to disengage the pinion from the rack.

4. The machine of claim 1 which includes:

(a) a motor mounting plate, said plate having:

(i) an upper side; and (ii) a lower side; and (iii) a motor shaft hole therethrough; and (iv) a pivot hole therethrough;

(b) a motor having a shaft, said motor being mounted on the upper side of the motor mounting plate so that the shaft extends through the motor shaft hole;

(c) a pinion that is mounted on the shaft and disposed on the lower side of the motor mounting plate, said pinion being adapted to engage with the rack on the track;

(d) a pivot bracket that is attached to the sled, said pivot bracket having a pivot hole therethrough;

(e) a rotation pin that is placed through the pivot hole in the pivot bracket and through the pivot hole in the motor mounting plate so as to pivotally mount the motor mounting plate to the sled.

5. The machine of claim 1 which includes:

(a) a motor mounting plate, said plate having:

(i) an upper side; and (ii) a lower side; and (iii) a motor shaft hole therethrough; and (iv) a first pivot hole therethrough; and (v) a second pivot hole therethrough;

(b) a motor having a shaft, said motor being mounted on the upper side of the motor mounting plate so that the shaft extends through the motor shaft hole;

(c) a pinion that is mounted on the shaft and disposed on the lower side of the motor mounting plate, said pinion being adapted to engage with the rack on the track;

(d) a first pivot bracket that is attached to the sled, said pivot bracket having a pivot hole therethrough that is adapted to be aligned with the first pivot hole through the motor mounting plate;

(e) a first rotation pin that is placed through the pivot hole in the first pivot bracket and through the first pivot hole in the motor mounting plate so as to pivotally mount the motor mounting plate to the sled;

(f) a second pivot bracket that is attached to the sled, said pivot bracket having a pivot hole therethrough that is adapted to be aligned with the second pivot hole through the motor mounting plate;

(g) a second rotation pin that is placed through the pivot hole in the second pivot bracket and through the second pivot hole in the motor mounting plate so as to pivotally mount the motor mounting plate to the sled.

6. The machine of claim 1 which includes:

(a) a motor mounting plate, said plate having:

(i) an upper side; and (ii) a lower side; and (iii) a motor shaft hole therethrough; and (iv) a pivot cylinder hole therethrough; and (v) a slot therethrough;

(b) a first pivot cylinder having a pivot hole therethrough, which pivot cylinder is rigidly mounted in the pivot cylinder hole of the motor mounting plate;

(c) a second pivot cylinder having a pivot hole therethrough, which pivot cylinder is adjustably mounted in the slot of the motor mounting plate;

(d) a motor having a shaft, said motor being mounted on the upper side of the motor mounting plate so that the shaft extends through the motor shaft hole;

(e) a pinion that is mounted on the shaft and disposed on the lower side of the motor mounting plate, said pinion being adapted to engage with the rack on the track;

(f) a first pivot bracket that is attached to the sled, said pivot bracket having a pivot hole therethrough that is adapted to be aligned with the pivot hole in the first pivot cylinder;

(g) a first rotation pin that is placed through the pivot hole in the first pivot bracket and through the pivot hole in the first pivot cylinder;

(h) a second pivot bracket that is attached to the sled, said pivot bracket having a pivot hole therethrough that is adapted to be aligned with the pivot hole in the second pivot cylinder;

(i) a second rotation pin that is placed through the pivot hole in the second pivot bracket and through the pivot hole in the second pivot cylinder;

(j) means for adjustably mounting the second pivot cylinder in a plurality of positions in the slot in the motor mounting plate.

7. The machine of claim 6 wherein:

(a) the motor mounting plate includes an adjustment hole;

(b) the means for adjustably mounting the second pivot cylinder in a plurality of positions in the slot in the motor mounting plate comprises:

(i) a cylinder plate that is rigidly mounted onto the second pivot cylinder adjacent to the motor mounting plate, said cylinder plate including a plurality of adjustment holes, each of which is adapted for alignment with the adjustment hole in the motor mounting plate, depending upon the position of the second pivot cylinder in the slot;

(ii) a pin which is adapted to be placed through an adjustment hole in the cylinder plate and into the adjustment hole in the motor mounting plate so as to fix the location of the second pivot cylinder with respect to the motor mounting plate.

8. The machine of claim 1 which includes a translation mechanism for driving the sled along the track, said translation mechanism comprising at least one actuator having a base end and a rod end, said rod end being movable, with respect to the base end, between a retracted configuration and an extended configuration, wherein one of said ends is attached to the sled and the other end is attached to a dog assembly that is adapted to engage with and disengage from the track so that the translation mechanism will move the sled in an incremental fashion along the track.

9. The machine of claim 8 wherein the drive system includes a control assembly that may be activated during operation of the translation mechanism:

(a) to permit the pinion to rotate freely when the dog assembly is engaged with the track;

(b) to act as a brake for the sled when the dog assembly is disengaged from the track.

10. The machine of claim 8 wherein:

(a) the means for rotating the pinion so as to drive the sled along the track comprises a hydraulic motor;

(b) the control assembly comprises:

(i) a hydraulic circuit for the hydraulic motor, said circuit including a valve;

(ii) a switch that is adapted to cause the valve to open when the dog assembly is engaged with the track and to cause the valve to close when the dog assembly is disengaged from the track.

11. An auger boring machine comprising:

(a) a track having an initial end and a terminal end, said track being comprised of a pair of track rails disposed in parallel relationship, each of which rails includes:

(i) a plurality of holes spaced therealong;

(ii) a rack mounted thereon;

(b) a sled that is mounted on the track and adapted to be moved between the initial end of the track and the terminal end thereof;

(c) an auger drive system for rotating an auger;

(d) a drive system mounted on the sled, which system comprises:

(i) a pair of motors, each of which has a shaft;

(ii) a pair of pinions, each of which is mounted on the shaft of one of the motors and oriented so as to engage with the rack on one of the rails of the track;

(e) a translation mechanism mounted on the sled, which mechanism comprises:

(i) a dog assembly having a pair of dogs that are adapted to engage with and disengage from the holes in the track rails;

(ii) a plurality of actuators, each of which has a base end and a rod end, said rod end being movable, with respect to the base end, between a retracted configuration and an extended configuration, wherein one of said ends is attached to the sled and the other end is attached to the dog assembly.

12. The machine of claim 11:

(a) wherein the drive system includes a pair of motor mounting plates, with each of said plates having:

(i) an upper side; and (ii) a lower side; and (iii) a motor shaft hole therethrough;

(b) wherein each motor is mounted on the upper side of one of the motor mounting plates so that the shaft extends through the motor shaft hole;

(c) which includes means for pivotally attaching each motor mounting plate to the sled, so that the motor mounting plate may be pivoted to disengage the pinion from the rack.

13. The machine of claim 11:

(a) wherein the drive system includes a pair of motor mounting plates, with each of said plates having:

(i) an upper side; and (ii) a lower side; and (iii) a motor shaft hole therethrough; and (iv) a pivot hole therethrough;

(b) wherein each motor is mounted on the upper side of one of the motor mounting plates so that the shaft extends through the motor shaft hole;

(c) which includes a pair of pivot brackets, each of which is attached to the sled and each of which has a pivot hole therethrough;

(e) which includes a pair of rotation pins, each of which is placed through the pivot hole in one of the pivot brackets and through the pivot hole in one of the motor mounting plates so as to pivotally mount said motor mounting plate to the sled.

14. The machine of claim 11:

(a) wherein each of the motors is a hydraulic motor;

(b) which includes a control assembly that may be activated during operation of the translation mechanism to permit the pinion to rotate freely when the dog assembly is engaged with the track and to act as a brake for the sled when the dog assembly is disengaged from the track, said control assembly comprising:

(i) a hydraulic circuit for the hydraulic motor, said circuit including a valve;

(ii) a switch that is adapted to cause the valve to open when the dog assembly is engaged with the track and to cause the valve to close when the dog assembly is disengaged from the track.

15. A method for operating an auger boring machine that is adapted to rotate an auger within a casing as the auger and casing are advanced into the ground, said machine further comprising:

(a) a track having an initial end and a terminal end, said track being provided with a rack;

(b) a sled that is mounted on the track and adapted to be moved between the initial end of the track and the terminal end thereof;

(c) means for rotating an auger on the sled;

(d) a first drive system comprising:

(i) a pinion which is mounted so as to engage with the rack on the track;

(ii) means for rotating the pinion;

which method comprises:

(e) rotating the pinion so as to drive the sled along the track.

16. The method of claim 15 which includes the following step instead of step (e) of claim 5:

(e) rotating the pinion so as to drive the sled along the track in the rearward direction to pull the auger out of the casing.

17. The method of claim 15 which includes the following step instead of step (e) of claim 5:

(e) rotating the pinion so as to drive the sled along the track in the rearward direction to pull the casing in order to reposition it.

18. The method of claim 15 which includes the following step instead of step (e) of claim 5:

(e) rotating the pinion so as to drive the sled along the track in the forward direction to push the auger into the casing.

19. The method of claim 15 which includes the following step instead of step (e) of claim 5:

(e) rotating the pinion so as to drive the sled along the track in the forward direction to place an underground utility product into a casing in the ground.

20. The method of claim 15 which includes the following step instead of step (e) of claim 5:

(e) rotating the pinion so as to drive the sled along the track in either or both of the forward and backward directions to mate the sled with a section of casing and a section of auger.

* * * * *

UNITED STATES PATENT AND TRADEMARK OFFICE

CERTIFICATE OF CORRECTION

PATENT NO. : 7,134,513 B1
APPLICATION NO. : 10/886808
DATED : November 14, 2006
INVENTOR(S) : Guy Randall et al.

It is certified that error appears in the above-identified patent and that said Letters Patent is hereby corrected as shown below:

On the Title page item [73] Assignee, delete "TX" and substitute therefor --TN--

At column 13, line 8, delete "5" and substitute --15--

At column 13, line 13, delete "5" and substitute therefor --15--

At column 13, line 18, delete "5" and substitute therefor --15--

At column 14, line 5, delete "5" and substitute therefor --15--

At column 14, line 10, delete "5" and substitute therefor --15--

Signed and Sealed this

Twenty-third Day of January, 2007

JON W. DUDAS
*Director of the United States Patent and Trademark Office*